US011492934B1

(12) United States Patent
Fluharty et al.

(10) Patent No.: US 11,492,934 B1
(45) Date of Patent: Nov. 8, 2022

(54) SYSTEMS AND METHODS FOR VARIABLE DISPLACEMENT ENGINE OIL FLOW

(71) Applicant: Ford Global Technologies, LLC, Dearborn, MI (US)

(72) Inventors: Jeff Fluharty, Woodhaven, MI (US); Jonathan Crowe, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/343,060

(22) Filed: Jun. 9, 2021

(51) Int. Cl.
*F01M 1/10* (2006.01)
*F01M 9/10* (2006.01)
*F01M 11/02* (2006.01)

(52) U.S. Cl.
CPC ..... *F01M 1/10* (2013.01); *F01M 9/104* (2013.01); *F01M 11/02* (2013.01); *F01M 2001/105* (2013.01); *F01M 2011/022* (2013.01); *F01M 2011/023* (2013.01)

(58) Field of Classification Search
CPC ..... F01M 1/10; F01M 9/104; F01M 11/02; F01M 2001/105; F01M 2011/022; F01M 2011/023; F01L 13/0005; F01L 1/24; F01L 1/053; F01L 1/18; F01L 1/181
See application file for complete search history.

(56) References Cited

U.S. PATENT DOCUMENTS 7,040,265 B2 * 5/2006 Falkowski ..... F01L 1/24 29/888.06
9,765,656 B2 9/2017 Beyer et al.
2008/0178828 A1 * 7/2008 Patel ..... F01L 13/0031 123/90.12
2017/0211431 A1 * 7/2017 Hashimoto ..... F01M 1/02

FOREIGN PATENT DOCUMENTS

GB 2539937 * 7/2015

* cited by examiner

*Primary Examiner* — Syed O Hasan
(74) *Attorney, Agent, or Firm* — Vincent Mastrogiacomo; McCoy Russell LLP

(57) ABSTRACT

Methods and systems are provided for oil flow for a variable displacement engine of a vehicle. In one example, a system may include an engine having a plurality of deactivatable cylinders capped by a cylinder head, an oil supply passage formed in the cylinder head and joined to a first oil inlet, deactivatable hydraulic lash adjusters (HLAs) arranged along a flow path of the oil supply passage, and a primer filter disposed within the cylinder head and fluidly coupling the oil supply passage to a second oil inlet. Oil may flow through the primer filter to the oil supply passage to maintain a flow rate of oil through the oil supply passage above a pre-determined flow rate.

17 Claims, 8 Drawing Sheets

SYSTEMS AND METHODS FOR VARIABLE DISPLACEMENT ENGINE OIL FLOW

FIELD

The present description relates generally to methods and systems for oil flow for a variable displacement engine of a vehicle.

BACKGROUND/SUMMARY

Variable displacement engines of vehicles often include hydraulic lash adjusters, with each hydraulic lash adjuster (HLA) configured to reduce a gap, or lash, between a corresponding rocker arm of the engine and a cam of a camshaft. Oil provided to each HLA via an oil passage of the engine may lubricate the components of each HLA, with a pressure of the oil engaging each HLA with the corresponding rocker arm. HLAs configured to engage with the rocker arms driving valves of deactivatable cylinders of the engine may be referred to as deactivatable HLAs. Each deactivatable HLA may include components configured to isolate a motion of the coupled rocker arm from the corresponding driven valve of the deactivatable cylinder during conditions in which pressurized oil is provided at an inlet of the deactivatable HLA by a second oil passage of the engine. By selectively providing the pressurized oil at the inlet of each deactivatable HLA, the deactivatable cylinders may be adjusted between an activated condition mode in which valves of the deactivatable cylinders are opened and closed by the rocker arms, and a deactivated condition mode in which the valves of the deactivatable cylinders are maintained in the closed position and not adjusted by the rocker arms.

However, the inventors herein have recognized potential issues with such systems. As one example, adjusting the deactivatable cylinders between the activated mode and deactivated mode may increase a likelihood of undesired oil flow from oil passages fluidly coupled to the deactivatable HLAs. The likelihood of undesired oil flow may increase with repeated adjustments between the activated mode and deactivated mode and may result in an increased likelihood of degradation of the deactivatable HLAs.

In one example, the issues described above may be addressed by a system comprising an engine including a plurality of deactivatable cylinders capped by a cylinder head, an oil supply passage formed in the cylinder head and joined to a first oil inlet, a plurality of deactivatable hydraulic lash adjusters (HLAs) arranged along a flow path of the oil supply passage and configured to receive engine oil directly from the oil supply passage to control deactivation of the plurality of deactivatable cylinders, and a primer filter disposed within the cylinder head and fluidly coupling the oil supply passage to a second oil inlet. In this way, the primer filter flows oil from the second oil inlet to the oil supply passage to more easily maintain a flow rate of oil through the oil supply passage above a pre-determined flow rate.

As one example, the primer filter includes an orifice to flow oil from the second oil inlet to the oil supply passage. The orifice may include different sections having different diameters, where the diameters decrease in a direction from the second oil inlet toward the oil supply passage. Oil may flow through the orifice from the second oil inlet to the oil supply passage responsive to a pressure differential between the second oil inlet and the oil supply passage. As a result, the flow rate of oil through the oil supply passage may be maintained above the pre-determined flow rate throughout multiple adjustments of the deactivatable hydraulic lash adjusters between an activated mode and deactivated mode, which may decrease a likelihood of degradation of the hydraulic lash adjusters and increase a response time performance of the deactivatable hydraulic lash adjusters.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-8 are shown approximately to scale, although other relative dimensions may be used, if desired.

DETAILED DESCRIPTION

The following description relates to systems and methods for a variable displacement engine of a vehicle. An engine, such as the engine shown by FIG. 1, includes a plurality of hydraulic lash adjusters, such as the hydraulic lash adjusters shown by FIG. 2. Each hydraulic lash adjuster may be coupled to a respective rocker arm. The hydraulic lash adjusters may be arranged within respective seats formed within a cylinder head of the engine, such as the cylinder head shown by FIGS. 3-8, with a plurality of the hydraulic lash adjusters being deactivatable to adjust between an activated mode and a deactivated mode. Each deactivatable hydraulic lash adjuster is configured to receive oil via passages formed within the cylinder head, such as the passages shown by FIGS. 4-5 and 7-8, and to adjust between the activated mode and deactivated mode responsive to a pressure of oil within the oil passages. The oil passages include primer filters, such as the primer filter shown by FIG. 5, configured to maintain a flow rate of oil to the oil passages above a pre-determined flow rate. As a result, the oil passages may be continuously provided oil via the primer filters, which may increase a reliability of the deactivatable hydraulic lash adjusters and/or reduce a likelihood of degradation of the deactivatable hydraulic lash adjusters.

Figure 1:
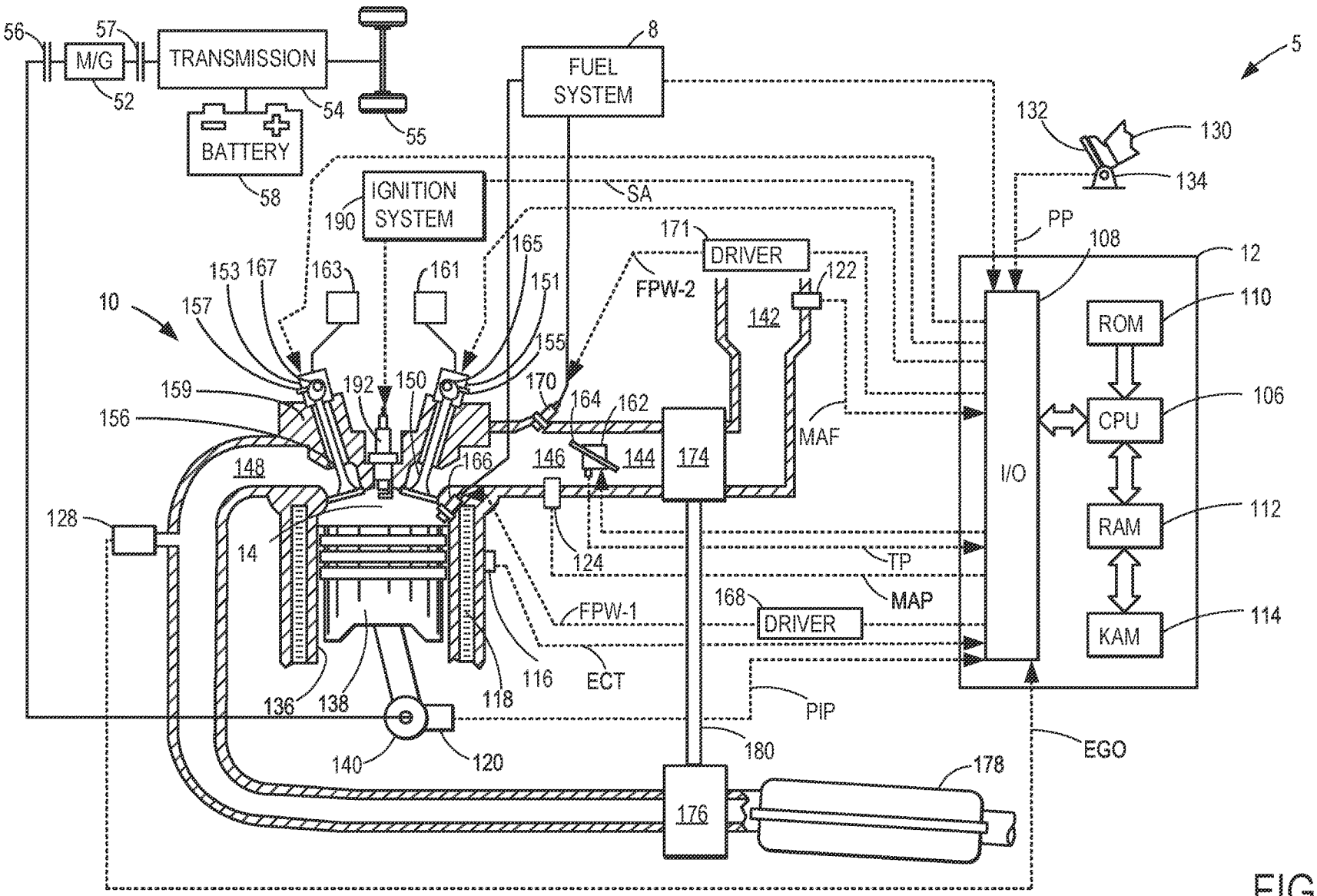
FIG. 1 shows a schematic diagram of an engine system including a plurality of intake valves and exhaust valves.

Referring now to FIG. 1, an example of a cylinder 14 (which may be referred to herein as a combustion chamber) of internal combustion engine 10 is shown included within vehicle 5. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 of engine 10 may include cylinder walls 136 capped by cylinder head 159. The cylinder head 159 includes a plurality of passages formed by interior surfaces of the cylinder head 159 and configured to flow hydraulic fluid (e.g., engine oil) to various components of the engine 10 (e.g., hydraulic lash adjusters as described further below). The cylinder 14 includes a piston 138 positioned therein. Piston 138 may be coupled to crankshaft 140 so that reciprocating motion of the piston is translated into rotational motion of the crankshaft. Crankshaft 140 may be coupled to at least one drive wheel of the vehicle 5 via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine 10. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 includes one or more intake valves and one or more exhaust valves. For example, cylinder 14 is shown including at least one intake valve 150 (e.g., intake poppet valve) and at least one exhaust valve 156 (e.g., exhaust poppet valve) located at an upper region of cylinder 14 (e.g., disposed within cylinder head 159). In some examples, each cylinder of engine 10, including cylinder 14, may include at least two intake valves and at least two exhaust valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams (e.g., intake cam 165 and exhaust cam 167, respectively) and may utilize one or more of cam profile switching (CPS), variable cam timing (VCT), variable valve timing (VVT) and/or variable valve lift (VVL) systems that may be operated by controller 12 to vary valve operation. The operation of intake valve 150 and exhaust valve 156 may be determined by valve position sensors (not shown) and/or camshaft position sensors 155 and 157, respectively. In alternative embodiments, one of the intake or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a shared valve actuator or actuation system, with the shared valve actuator configured to actuate both of the intake valve and exhaust valve.

The intake valve and exhaust valve may each be coupled to a respective valve drive assembly configured to control a motion (e.g., opening and closing) of the intake valve and exhaust valve. In particular, intake valve 150 is shown coupled to valve drive assembly 161, and exhaust valve 156 is shown coupled to valve drive assembly 163. Each of the valve drive assemblies includes a respective hydraulic lash adjuster (HLA) and a respective rocker arm, with the rocker arm arranged between the HLA and the corresponding driven valve (e.g., intake valve or exhaust valve). The HLA is configured to reduce a lash, or gap, between the rocker arms and the cams of the camshaft. For example, valve drive assembly 161 includes an intake HLA configured to reduce a lash between a rocker arm of valve drive assembly 161 and intake cam 165, and valve drive assembly 163 includes an exhaust HLA configured to reduce a lash between a rocker arm of valve drive assembly 163 and exhaust cam 167.

In some examples, the cylinder 14 may be a deactivatable cylinder, with the HLAs of the valve drive assembly 161 and the valve drive assembly 163 being deactivatable HLAs. For example, the valve drive assembly 161 may include a deactivatable HLA configured to selectively disable the opening and closing of the intake valve 150 responsive to a flow of pressurized oil provided at an inlet (which may be referred to herein as a deactivation inlet) of the deactivatable HLA via an oil passage within cylinder head 159. By disabling the opening and closing of the intake valve 150 via the deactivatable HLA, combustion of fuel and air within the cylinder 14 may be disabled (e.g., in order to temporarily reduce a torque output and/or fuel consumption of the engine). The flow of pressurized oil to the inlet of the deactivatable HLA may be controlled by controller 12 via one or more oil flow valves (e.g., solenoid valves), with the oil flow valves controlling the flow of oil within the oil passage connected to the inlet of the deactivatable HLA. Adjusting a deactivatable HLA to disable the opening and closing of the associated driven valve (e.g., intake valve 150) may be referred to herein as adjusting the deactivatable HLA to a deactivated mode, while adjusting the deactivatable HLA to enable the opening and closing of the associated driven valve may be referred to herein as adjusting the deactivatable HLA to an activated mode.

The controller may transmit electrical signals to the oil flow valves order to adjust the oil flow valves to a fully closed position, a fully opened position, or a plurality of positions between the fully closed position and the fully opened position. In one example, the intake valve 150 may be driven by the valve drive assembly 161 (e.g., opened and closed by a pivoting of the rocker arm of the valve drive assembly 161) during conditions in which pressurized oil is provided to the inlet of the deactivatable HLA of the valve drive assembly 161 by adjusting the oil flow valves to the fully opened position. The opening and closing of the intake valve 150 may be disabled during conditions in which pressurized oil is not provided to the inlet of the deactivatable HLA of the valve drive assembly 161 (e.g., by adjusting the oil flow valves to the fully closed position). Although operation of the intake valve 150 is described herein as an example, the exhaust valve 156 may operate in a similar way (e.g., with the operation of the exhaust valve 156 being adjusted via the valve drive assembly 163).

Although valve drive assembly 161 and intake valve 150 are described above as an example, the valve drive assembly 163 and exhaust valve 156 may include a similar configuration (e.g., valve drive assembly 163 may include a deactivatable HLA configured to disable an opening and closing of exhaust valve 156). In other examples, the cylinder 14 may be a non-deactivatable cylinder, with the HLAs of the valve drive assembly 161 and valve drive assembly 163 being non-deactivatable HLAs that are not configured to disable the opening and closing of the respective driven valves. Engine 10 is configured to include deactivatable cylinders and non-deactivatable cylinders such that engine 10 is a variable displacement engine (e.g., one or more cylinders of engine 10 may be selectably deactivated as described above in order to adjust an output of the engine 10). Similar to the examples described below (e.g., with reference to FIG. 2), engine 10 may be configured as a V8 engine including two cylinder banks, with each cylinder bank including four cylinders (e.g., similar to cylinder 14) and with one or more of the cylinders being configured as a deactivatable cylinder, similar to the example described above. However, in other examples, the engine 10 may have a different number of cylinders (e.g., four, six, ten, twelve, etc.) and/or a different number of cylinder banks (e.g., a single cylinder bank).

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors (e.g., fuel injector 166 and fuel injector 170). Fuel injector 166 and fuel injector 170 may be configured to deliver fuel received from fuel system 8. Fuel system 8 may include one or more fuel tanks, fuel pumps, and/or fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake air passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver (e.g., electronic driver 168 or electronic driver 171) may be used for both fuel injection systems, or multiple drivers, for example electronic driver 168 for fuel injector 166 and electronic driver 171 for fuel injector 170, may be used, as depicted.

In an alternate example, each of fuel injector 166 and fuel injector 170 may be configured as direct fuel injectors for injecting fuel directly into cylinder 14. In still another example, each of fuel injector 166 and fuel injector 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle (e.g., combustion cycle) of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injector 166 and fuel injector 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among fuel injector 170 and fuel injector 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

The controller 12 receives signals from the various sensors of FIG. 1 and employs the various actuators of FIG. 1 to adjust engine operation based on the received signals and instructions stored on a memory of the controller. For example, in configurations in which cylinder 14 is a deactivatable cylinder, adjusting the intake valve 150 from an activated condition in which the intake valve 150 is opened and closed by valve drive assembly 161 to a deactivated condition in which the intake valve 150 is not opened and closed by valve drive assembly 161 may include increasing a pressure of oil provided to an inlet (e.g., deactivation inlet) of the deactivatable HLA of the valve drive assembly 161. For example (as described above), the controller 12 may transmit electrical signals to one or more oil control valves configured to control the flow of pressurized oil to the inlet of the deactivatable HLA via the oil passage of the cylinder head 159 in order to move the oil control valves to an opened position to provide the pressurized oil at the inlet of the deactivatable HLA. Similar to the examples described below with reference to FIGS. 2 and 3-8, each deactivatable HLA of the engine 10 is fluidly coupled to a respective primer filter configured to maintain a flow rate of oil through the passages of the engine 10 above a pre-determined flow rate, where the oil is provided to the deactivatable HLAs via the passages. The primer filters may be similar to, or the same as, the primer filter shown by FIG. 5 and described below, for example.

As described above, FIG. 1 shows only one cylinder of a multi-cylinder engine. As such, each cylinder may similarly include its own set of intake/exhaust valves, hydraulic lash adjusters, rocker arms, fuel injector(s), spark plug, etc. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches are engaged. In the depicted example, a first clutch 56 is provided between crankshaft 140 and electric machine 52, and a second clutch 57 is provided between electric machine 52 and transmission 54. Controller 12 may send a signal to an actuator of each clutch (e.g., first clutch 56 and/or second clutch 57) to engage or disengage the clutches, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Figure 2:
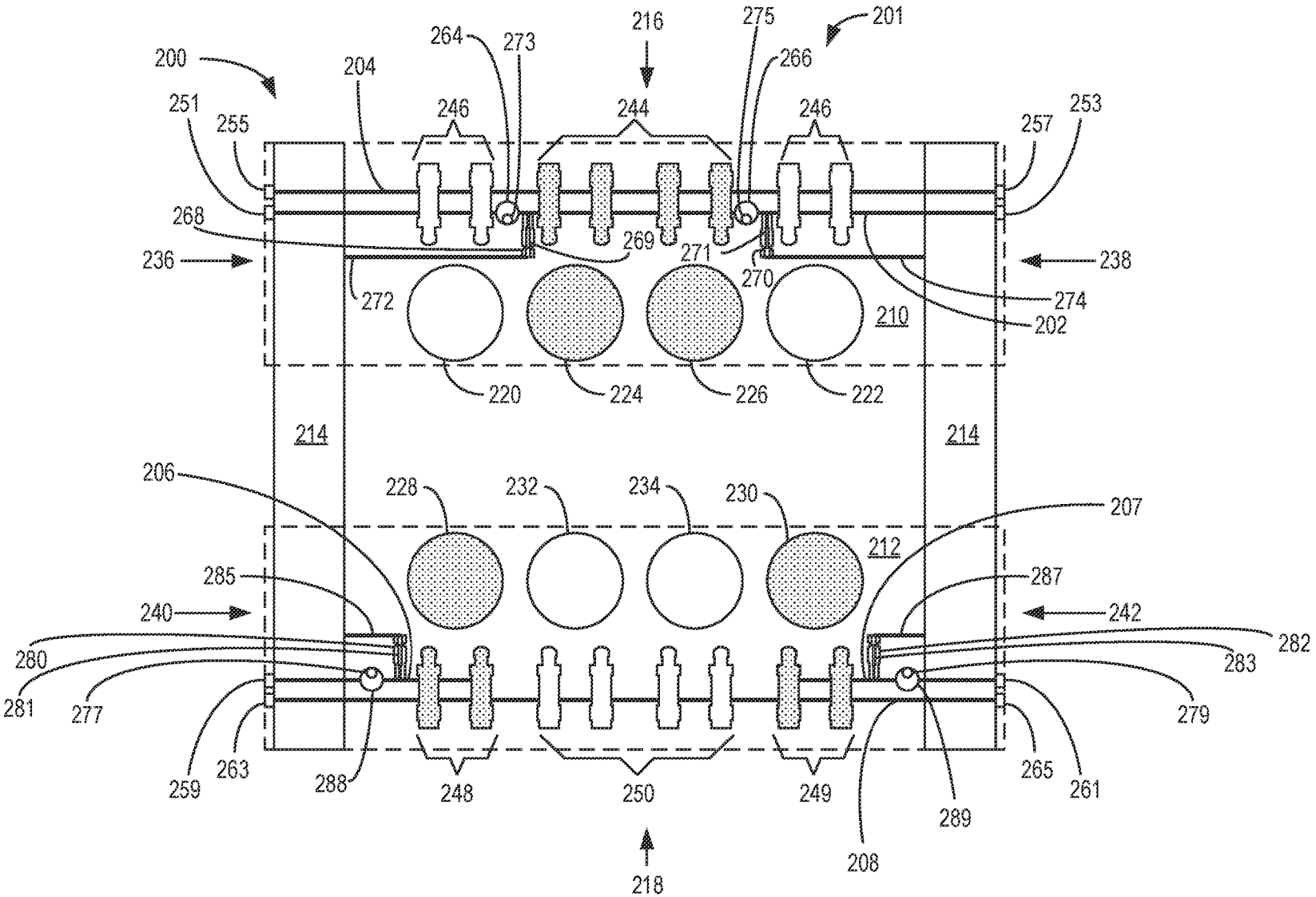
FIG. 2 shows a schematic diagram of an engine system including a cylinder head having oil passages fitted with primer filters and connected to hydraulic lash adjusters.

Referring to FIG. 2, an engine 200 is shown. The engine 200 may be similar to, or the same as, the engine 10 shown by FIG. 1 and described above and includes cylinder head 201 which may be similar to, or the same as, the cylinder head 159 described above. Engine 200 includes several components that may be similar to, or the same as, the components described above with reference to FIG. 1. For example, engine 200 includes cylinders which may be similar to, or the same as, cylinder 14 described above.

The engine 200 is configured as a V8 engine including two cylinder banks, with each cylinder bank arranged at an opposing side of the engine 200. In particular, engine 200 includes a first cylinder bank 210 arranged at a first side 216 of the engine 200, and a second cylinder bank 212 arranged at an opposing, second side 218 of the engine 200. The first cylinder bank 210 includes four cylinders arranged in an inline configuration, and the second cylinder bank 212 is arranged parallel with the first cylinder bank 210 and includes four cylinders arranged in an inline configuration. In particular, the first cylinder bank 210 includes first outer cylinder 220, second outer cylinder 222, first inner cylinder 224, and second inner cylinder 226, and the second cylinder bank 212 includes third outer cylinder 228, fourth outer cylinder 230, third inner cylinder 232, and fourth inner cylinder 234. The first outer cylinder 220 is arranged at a first side 236 of the first cylinder bank 210 and the second outer cylinder 222 is arranged at an opposing, second side 238 of the first cylinder bank 210. The third outer cylinder 228 is arranged at a first side 240 of the second cylinder bank 212 and the fourth outer cylinder 230 is arranged at an opposing, second side 242 of the second cylinder bank 212. One or more of the cylinders of the first cylinder bank 210 may be configured to be deactivatable (e.g., similar to the example described above with reference to FIG. 1), and one or more of the cylinders of the second cylinder bank 212 may be configured to be deactivatable. In the example shown, the shading pattern indicates the cylinders that are deactivatable, while the cylinders that are shown without shading are non-deactivatable.

The engine 200 further includes a plurality of hydraulic lash adjusters (HLAs) arranged at each cylinder bank. In particular, the first cylinder bank 210 includes deactivatable HLAs 244 (indicated with the shading pattern) and non-deactivatable HLAs 246, and the second cylinder bank 212 includes deactivatable HLAs 248, deactivatable HLAs 249, and non-deactivatable HLAs 250. The deactivatable HLAs 244 of the first cylinder bank 210 may control deactivation of the first inner cylinder 224 and second inner cylinder 226, the deactivatable HLAs 248 of the second cylinder bank 212 may control deactivation of the third outer cylinder 228, and the deactivatable HLAs 249 may control deactivation of the fourth outer cylinder 230.

Each of the deactivatable HLAs 244 and non-deactivatable HLAs 246 of the first cylinder bank 210 are fed (e.g., provided oil) by a first oil supply passage 202 and a second oil supply passage 204. The first oil supply passage 202 and second oil supply passage 204 each extend from first side 236 of the first cylinder bank 210 to opposing, second side 238 of the first cylinder bank 210. In some examples, the first oil supply passage 202 and second oil supply passage 204 may be arranged parallel to each other.

The first oil supply passage 202 and second oil supply passage 204 each fluidly couple to the deactivatable HLAs 244 and non-deactivatable HLAs 246 of the first cylinder bank 210. In particular, the first oil supply passage 202 and second oil supply passage 204 each fluidly couple to respective oil inlets (e.g., lash adjustment inlet and deactivation inlet) of the deactivatable HLAs 244 without any intervening oil passages, and the first oil supply passage 202 fluidly couples to a respective oil inlet of each non-deactivatable HLA 246 without any intervening oil passages. In some examples, one or more of the first oil supply passage 202 and/or second oil supply passage 204 may include restrictors, plugs, etc. configured to control the flow of oil to the deactivatable HLAs 244 and/or non-deactivatable HLAs 246. For example, although the first oil supply passage 202 is shown connected to each of the deactivatable HLAs 244 and each of the non-deactivatable HLAs 246, the first oil supply passage 202 may include one or more plugs disposed therein to control (e.g., restrict, direct, etc.) the flow of oil through the first oil supply passage 202.

The first oil supply passage 202 is shown including a first primer filter 268 arranged toward first side 236 and a second primer filter 270 arranged toward second side 238. The first oil supply passage 202 is configured to receive oil from engine block 214, and during conditions in which a pressure of the oil within the first oil supply passage 202 exceeds a deactivation pressure of the deactivatable HLAs 244, the deactivatable HLAs 244 are configured to adjust from the activated mode to the deactivated mode. During conditions in which the pressure of the oil within the first oil supply passage 202 decreases below the deactivation pressure, the deactivatable HLAs 244 are configured to adjust from the deactivated mode to the activated mode. The controller of the engine (e.g., similar to controller 12 described above with reference to FIG. 1) may control an amount of opening of a valve 264 and an amount of opening of valve 266 in order to control a pressure of oil within the first oil supply passage 202. For example, the controller may adjust valve 264 and/or valve 266 to a fully opened position in order to increase a pressure of oil within the first oil supply passage 202. Although the engine 200 includes both of the valve 264 and the valve 266 in the example shown, in other examples the engine may include only one of valve 264 or valve 266. The valve 264 and the valve 266 may each be solenoid-actuated valves (e.g., solenoid valves), in some examples.

The engine 200 further includes a first primer filter 268 arranged toward the first side 236 and a second primer filter 270 arranged toward the second side 238. Each of the first primer filter 268 and second primer filter 270 is fluidly coupled to engine block 214 via a respective passage. In particular, first primer filter 268 is fluidly coupled to engine block 214 by passage 272, and second primer filter 270 is fluidly coupled to engine block 214 by passage 274. The passage 272 joins to first oil supply passage 202 downstream of the first primer filter 268, and the passage 274 joins to first oil supply passage 202 downstream of the second primer filter 270. Each of the first primer filter 268 and second primer filter 270 is configured to continuously flow oil from the engine block 214 to the first oil supply passage 202 to maintain a flow rate of oil through the first oil supply passage 202 above a pre-determined flow rate. The flow rate may be maintained above the pre-determined flow rate independent of the operating mode of the deactivatable HLAs (e.g., independent of whether the deactivatable HLAs are in the activated mode or the deactivated mode). For example, the flow rate may be maintained above the pre-determined flow rate via the primer filters during conditions in which one or more of the deactivatable HLAs (e.g., all of the deactivatable HLAs) are in the activated mode. The first primer filter 268 is configured such that oil may flow through the first primer filter 268 from the passage 272 to the first oil supply passage 202 even during conditions in which the valve 264 is closed (e.g., closed to the first oil supply passage 202). The oil may flow through the first primer filter 268 passively (e.g., automatically), without adjustment to the first primer filter 268 by the controller. In particular, oil may flow through the first primer filter 268 from the passage 272 to the first oil supply passage 202 automatically, without actuation, energization, etc. of any portion of the first primer filter 268.

The first oil supply passage 202 is sealed (e.g., plugged) at both of the first side 236 of the first cylinder bank 210 and the second side 238 of the first cylinder bank 210. In the example shown, the first oil supply passage 202 is sealed by a first plug 251 arranged at the first side 236 of the first cylinder bank 210 and a second plug 253 arranged at the second side 238 of the first cylinder bank. Further, the second oil supply passage 204 is sealed by a third plug 255 arranged at the first side 236 of the first cylinder bank 210 and a fourth plug 257 arranged at the second side 238 of the first cylinder bank 210. The third oil supply passage 206 is sealed by a fifth plug 259 at the first side 240 of the second cylinder bank 212, the fourth oil supply passage 208 is sealed by a sixth plug 263 at the first side 240 of the second cylinder bank 212 and a seventh plug 265 at the second side 242 of the second cylinder bank 212, and the fifth oil supply passage 207 is sealed by an eighth plug 261 at the second side 242 of the second cylinder bank 212.

In the example shown, the first primer filter 268 includes an orifice 269, where oil may flow through the orifice 269 from the passage 272 to the first oil supply passage 202. The orifice 269 extends through an entire length of the first primer filter 268 and is shaped such that the flow rate of oil through the orifice 269 is much lower (e.g., much less) than a flow rate of oil from the engine block 214 through the valve 264 during conditions in which the valve 264 is adjusted to a fully opened position. Although the flow rate of oil through the orifice 269 is lower than the flow rate of oil through the valve 264 while the valve 264 is fully opened, the orifice 269 is configured such that the flow rate of oil through the orifice 269 does not decrease below the pre-determined flow rate. In one example, the flow rate of oil through the orifice 269 may be less than 5% of the flow rate of oil through the valve 264 during conditions in which the valve 264 is fully opened, with the orifice 269 configured to maintain the flow rate above a pre-determined flow rate of 2% of the flow rate of oil through the fully opened valve 264. As another example, the flow rate of oil through the orifice 269 may be 0.3 liters per minute, with the orifice 269 configured to maintain the flow rate above a pre-determined flow rate of 0.2 liters per minute. As yet another example, the flow rate of oil through the orifice 269 may be between 0.2 and 0.5 liters per minute (e.g., during conditions in which a temperature of the oil is approximately 90 degrees Celsius), with the flow rate increasing for higher pressure differentials between engine block 214 and first oil supply passage 202, and with the flow rate decreasing for lower pressure differentials between engine block 214 and first oil supply passage 202, and with the orifice 269 configured to maintain the flow rate above a pre-determined flow rate of 0.2 liters per minute. As another example, a rate of pressure change to the oil within the first oil supply passage 202 due to the oil flow through the orifice 269 to the first oil supply passage 202 may be much smaller than (e.g., less than 5% of) a rate of pressure change to the oil within the first oil supply passage 202 during adjustment of the valve 264 from the fully closed position to the fully opened position. The orifice 269 is configured such that the flow rate through the orifice does not decrease below the pre-determined flow rate during conditions in which the engine is on (e.g., the engine is started and fuel and air are combusted within one or more cylinders of the engine).

The pre-determined flow rate described above may be a non-zero flow rate at which a likelihood of removal of contaminants (e.g., air, debris, etc.) from the oil passages is increased. In some examples, the pre-determined flow rate may be between 0.05 liters per minute and 0.2 liters per minute. As oil flows from the first primer filter 268 to the first oil supply passage 202 via orifice 269, the oil flowing to the first oil supply passage 202 may increase a pressure of oil within the first oil supply passage 202. The valve 264 includes a pressure relief port 273 configured to open responsive to the pressure of the oil within the first oil supply passage 202 being greater than a threshold pressure, where the threshold pressure may be a relatively low pressure (e.g., 0.3 bar) compared to a pressure of oil within the passage 272 and engine block 214. The pressure relief port 273 may be fluidly coupled to a sump or crankcase of the engine, such that oil may flow from the pressure relief port 273 to the sump or crankcase. Because the first primer filter 268 is configured to continuously flow oil to the first oil supply passage 202, the continuous flow of oil may maintain the pressure of oil within the first oil supply passage 202 at approximately the threshold pressure (or slightly above the threshold pressure). During conditions in which the pressure relief port 273 is opened (e.g., the pressure of oil within the first oil supply passage 202 is at least the threshold pressure), oil may flow continuously from the first primer filter 268 to the first oil supply passage 202 and through the pressure relief port 273 of the valve 264 to the sump or crankcase of the engine. The pressure relief port 273 may be shaped such that the flow rate of oil through the pressure relief port is approximately the same as (e.g., equal to) the flow rate of oil through the first primer filter 268. In this way, by continuously flowing oil from the first primer filter 268 to the first oil supply passage 202, a likelihood of accumulation of contaminants within the first oil supply passage 202 may be reduced, which may increase reliability and/or performance of the deactivatable HLAs receiving oil via the first oil supply passage 202 and/or reduce a likelihood of degradation of the deactivatable HLAs.

As described herein, adjusting the position of a valve (e.g., adjusting an amount of opening of the valve) refers to adjusting an amount of opening of an oil flow pathway between the engine block 214 and a corresponding oil passage fluidly coupled to the valve, where the corresponding oil passage is fluidly coupled to one or more HLAs as described above. Adjusting the position of the valve does not refer to opening and/or closing a pressure relief port of the valve. As one example, adjusting the position of valve 264 refers to adjusting an amount of opening of the valve 264 to adjust a flow of oil through the valve 264 from the engine block 214 to the first oil supply passage 202. Adjusting the position of valve 264 does not refer to opening or closing the pressure relief port 273 of the valve 264. It should be appreciated that adjusting the amount of opening of the valve 264 (e.g., to adjust the flow of oil through the valve 264 from the engine block 214 to the first oil supply passage 202) may be controlled by the controller (e.g., controller 12 described above with reference to FIG. 1), while the opening and closing of the pressure relief port 273 occurs automatically (e.g., without actuation, energization, etc. of any portion of the valve 264) responsive to the pressure of oil within the first oil supply passage 202 being greater than the threshold pressure. Controlling the amount of opening of the valve 264 may include sending (e.g., transmitting) electronic signals from the controller to the valve 264. Although the valve 264 is described above, the valve 266, valve 288, and valve 289 may operate in a similar way.

Oil may flow through the orifice 269 of the first primer filter 268 responsive to a pressure differential between the engine block 214 (with the oil pressure in the engine block being the same as the oil pressure in the passage 272 and passage 274) and the first oil supply passage 202. The pressure of the oil within the first oil supply passage 202 may be controlled by the controller via adjustment of an amount of opening and/or opening timing of valve 264 and/or valve 266. During conditions in which none of the deactivatable HLAs are in the deactivated mode (e.g., valve 264 and valve 266 are in the fully closed position, such that oil does not flow from the engine block 214 through valve 264 or valve 266 to the first oil supply passage 202), the pressure differential between the engine block 214 and the first oil supply passage 202 may be greater than the pressure differential between the engine block 214 and the first oil supply passage 202 during conditions in which one or more of the deactivatable HLAs is in the deactivated mode (e.g., conditions in which valve 264 and/or valve 266 is opened to flow oil from the engine block to first oil supply passage 202). For example, during conditions in which the valve 264 and the valve 266 are in the fully closed position and the deactivatable HLAs are in the activated mode, the pressure of oil within the first oil supply passage 202 may be much lower than the pressure of oil in the engine block 214, upstream of the valve 264 and the valve 266.

Due to the pressure differential between the oil in the first oil supply passage 202 and the oil within the engine block 214, oil may flow from the engine block 214 through the orifice 269 of the first primer filter 268 and into the first oil supply passage 202, which results in the pressure differential between the first oil supply passage 202 and the engine block 214 decreasing toward zero (e.g., the absolute value of the pressure differential decreases toward zero). For example, as oil flows from the engine block 214 to the first oil supply passage 202 via the first primer filter 268, the pressure of oil within the first oil supply passage 202 may increase while the pressure of oil within the engine block 214 may remain relatively the same (e.g., the pressure of oil within the engine block 214 may be maintained via operation of the engine, which may include pumping of the oil through the engine block 214 via an oil pump driven by a crankshaft of the engine while fuel and air are combusted within cylinders of the engine). As the pressure of oil within the first oil supply passage 202 increases due to oil flowing through the first primer filter 268 from the engine block 214 and into the first oil supply passage 202, the pressure differential between the first oil supply passage 202 and the engine block 214 decreases (e.g., the difference in oil pressure between the first oil supply passage 202 and the engine block 214 becomes smaller). As the pressure differential between the engine block 214 and the first oil supply passage 202 decreases (e.g., approaches zero), a tendency of oil to flow from the engine block 214 through the first primer filter 268 to the first oil supply passage 202 may decrease (e.g., the flow rate of oil from the engine block 214 through the orifice 269 to the first oil supply passage 202 may be a function of the pressure differential, such as proportional to the pressure differential).

To further maintain the flow rate of oil from the engine block 214 through the first primer filter 268 to the first oil supply passage 202 above the pre-determined flow rate, the pressure relief port 273 of the valve 264 is configured to open responsive to the pressure of oil within the first oil supply passage 202 being higher than the threshold pressure. The threshold pressure may be much lower than the pressure of oil within the engine block 214 (e.g., the threshold pressure may be 0.3 bar and the pressure of oil within the engine block 214 may at least 2 bar). During conditions in which the pressure relief port 273 of the valve 264 is opened, oil from the first oil supply passage 202 may flow through the pressure relief port 273 and out of the first oil supply passage 202 to the sump or crankcase.

In this way, although oil may flow into the first oil supply passage 202 from the engine block 214 via the first primer filter 268, oil may also flow out of the first oil supply passage 202 via the pressure relief port 273 of the valve 264. The flow of oil into the first oil supply passage 202 via the first primer filter 268 and the flow of oil out of the first oil supply passage 202 via the pressure relief port 273 of the valve 264 results in a continuous flow of oil through the first oil supply passage 202 during conditions in which the engine is on. As a result, a likelihood of accumulation of contaminants (e.g., air and/or debris) within the first oil supply passage 202 may be reduced, which may reduce a likelihood of contaminants infiltrating the deactivatable HLAs and non-deactivatable HLAs and may increase a performance and/or reliability of the HLAs.

As an example operation of the engine, the engine may be operating with each of the cylinders of the engine in the activated mode (e.g., with each of the deactivatable HLAs of the engine being in the activated mode, with each cylinder of the engine combusting fuel and air). The pressure of oil within the engine block 214 may be a higher, first pressure (e.g., 2 bar, or higher) and the pressure of oil within the first oil supply passage 202 may be a lower, second pressure (e.g., 0.3 bar). The pressure of oil within the first oil supply passage 202 may be higher than the threshold pressure such that the pressure relief port 273 of the valve 264 remains in the opened position. As oil flows out of the first oil supply passage 202 through the pressure relief port 273 of the valve 264, the oil is replaced by oil flowing into the first oil supply passage 202 via the first primer filter 268. In this condition, the flow rate of the oil through the first oil supply passage 202 may be maintained above the pre-determined flow rate, with the flow rate of oil out of the first oil supply passage 202 being in equilibrium with (e.g., equal to) the flow rate of oil into the first oil supply passage 202.

Further, during conditions in which the pressure of oil within the first oil supply passage 202 is less than the threshold pressure (e.g., immediately following a start event of the engine in which the engine is transitioned from an OFF condition in which fuel and air are not combusted within any cylinders to an ON condition in which fuel and air are combusted within at least one cylinder), the pressure relief port 273 is in the closed position such that oil does not flow out of the first oil supply passage 202 via the pressure relief port 273. However, oil flows into the first oil supply passage 202 via the first primer filter 268, and because the pressure differential between the first oil supply passage 202 and the engine block 214 is relatively high during the condition in which the oil pressure within the first oil supply passage 202 is below the threshold pressure, the flow rate of oil into the first oil supply passage 202 via the first primer filter 268 is maintained above the pre-determined flow rate. As the pressure of oil within the first oil supply passage 202 transitions above the threshold pressure, the pressure relief port 273 of the valve 264 opens and further maintains the flow rate of oil through the first oil supply passage 202 above the pre-determined flow rate. Although the valve 264 is described above as including the pressure relief port 273, each of the valve 266, valve 288, and valve 289 include a similar pressure relief port and may operate in a similar way (e.g., valve 266 is shown including pressure relief port 275, valve 288 is shown including pressure relief port 277, and valve 289 is shown including pressure relief port 279).

The shape (e.g., diameter, length, etc.) of the orifice 269 is configured to provide a sufficient flow rate of oil through the first primer filter 268 to maintain the flow rate of oil through the first oil supply passage 202 above the pre-determined flow rate. The pre-determined flow rate may be a flow rate associated with a desired rate of replacement of the oil within the first oil supply passage 202. For example, flowing oil to the first oil supply passage 202 at the pre-determined flow rate may provide a rate of replacement of oil within the first oil supply passage 202 of 0.05 liters per minute, 0.2 liters per minute, etc. By configuring the first primer filter 268 to maintain the flow rate of oil to the first oil supply passage 202 above the pre-determined flow rate, the rate of replacement of oil within the first oil supply passage 202 may be increased, which may reduce a likelihood of accumulation of contaminants within the first oil supply passage 202, increase a lubrication and/or cooling of the HLAs fluidly coupled to the first oil supply passage 202, etc.

By configuring the first primer filter 268 to flow oil to the first oil supply passage 202 responsive to a pressure differential between the first oil supply passage 202 and the engine block 214, a reliability and/or performance of the deactivatable HLAs receiving oil via the first oil supply passage 202 may be increased and a likelihood of degradation of the deactivatable HLAs may be reduced. For example, during operation of the engine 200, undesired introduction of contaminants such as oil, debris, etc. to the oil supply passages fluidly coupled to the HLAs, such as the first oil supply passage 202, may increase a likelihood of degradation of the oil supply passages and/or HLAs, delay a commanded adjustment of the deactivatable HLAs from the activated mode to the deactivated mode (e.g., increase a response time of the deactivatable HLAs), etc. Further, low flow rates may increase a likelihood of accumulation of said contaminants. By maintaining the flow rate of oil to first oil supply passage 202 via the first primer filter 268 above the pre-determined flow rate, the rate of oil replacement within the first oil supply passage 202 may be increased, which may increase a likelihood of flushing of contaminants from the first oil supply passage 202 and decrease a likelihood of degradation and/or undesired delay of the deactivatable HLAs. The first primer filter 268 is configured such that oil flows automatically through the first primer filter 268 to the first oil supply passage 202 responsive to the pressure differential between the engine block 214 and the first oil supply passage 202 without actuation, energization, adjustment, etc. of the first primer filter 268 or other components. Although the first primer filter 268 is described above, it should be appreciated that the other primer filters described herein, such as the second primer filter 270, may include a similar configuration (e.g., the second primer filter 270 may have a same shape as the first primer filter 268 and may include an orifice similar to orifice 269 configured to flow oil to the first oil supply passage 202 responsive to a pressure differential between the engine block 214 and the first oil supply passage 202).

The first oil supply passage 202 and second oil supply passage 204 may each supply oil to the corresponding HLAs. In particular, the first oil supply passage 202 and second oil supply passage 204 are oil passages dedicated to providing engine oil to the deactivatable HLAs 244 and non-deactivatable HLAs 246 and are maintained separate from (e.g., spaced apart from) a main oil gallery of the engine 200 (e.g., only the first oil supply passage 202 and second oil supply passage 204 flow oil to the corresponding HLAs at the first cylinder bank 210). The main oil gallery does not directly couple to any of the deactivatable HLAs 244 or the non-deactivatable HLAs 246. The first oil supply passage 202 and second oil supply passage 204 each may receive oil via engine block 214 of the engine 200.

The engine 200 further includes third oil supply passage 206 fluidly coupling directly to the deactivatable HLAs 248, fourth oil supply passage 208 fluidly coupling directly to each of the deactivatable HLAs 248 and the deactivatable HLAs 249, and fifth oil supply passage 207 fluidly coupling directly to the deactivatable HLAs 249. In particular, the third oil supply passage 206 fluidly couples to deactivation oil inlets of the deactivatable HLAs 248 arranged toward first side 240, while the fifth oil supply passage 207 fluidly couples to deactivation oil inlets of the deactivatable HLAs 249 arranged toward second side 242. During conditions in which pressurized oil is provided by the oil supply passages to the deactivation oil inlets of the deactivatable HLAs 248, the deactivatable HLAs 248 may adjust from the activated mode to the deactivated mode. Similarly, during conditions in which pressurized oil is provided by the oil supply passages to the deactivation oil inlets of the deactivatable HLAs 249, the deactivatable HLAs 249 may adjust from the activated mode to the deactivated mode.

The fourth oil supply passage 208 fluidly couples to respective lash adjustment oil inlets of the deactivatable HLAs 248. The third oil supply passage 206 and the fifth oil supply passage 207 do not fluidly couple to the non-deactivatable HLAs 250 of the second cylinder bank 212. The fourth oil supply passage 208 fluidly couples directly to a respective lash adjustment oil inlet of each non-deactivatable HLA 250. Although the fourth oil supply passage 208 may extend through an entire length of the second cylinder bank 212, the third oil supply passage 206 and fifth oil supply passage 207 may each extend only partially through the second cylinder bank 212 and may terminate within an interior of the second cylinder bank 212. The third oil supply passage 206 and fifth oil supply passage 207 are connected to the opposing sides of the second cylinder bank 212. In particular, third oil supply passage 206 extends to the first side 240 of the second cylinder bank 212, and fifth oil supply passage 207 extends to the second side 242 of the second cylinder bank 212). In this configuration, the third oil supply passage 206 and fifth oil supply passage 207 do not feed the non-deactivatable HLAs 250 associated with the third inner cylinder 232 and fourth inner cylinder 234. In some examples, the deactivatable HLAs 248 may be identical to the deactivatable HLAs 249 (e.g., deactivatable HLAs 248 may have a same size, shape, material, etc. as the deactivatable HLAs 249).

Although the fourth oil supply passage 208 is shown connected to each of the deactivatable HLAs 248, each of the deactivatable HLAs 249, and each of the non-deactivatable HLAs 250, the fourth oil supply passage 208 may include one or more plugs disposed therein to control (e.g., restrict, direct, etc.) the flow of oil through the fourth oil supply passage 208 to the deactivatable HLAs 248, deactivatable HLAs 249, and/or non-deactivatable HLAs 250.

The third oil supply passage 206, fourth oil supply passage 208, and fifth oil supply passage 207 are oil passages dedicated to providing engine oil to the deactivatable HLAs (e.g., with third oil supply passage 206 configured to provide oil to deactivatable HLAs 248 and with fifth oil supply passage 207 configured to provide oil to deactivatable HLAs 249) and non-deactivatable HLAs 250 and are maintained separate from (e.g., spaced apart from) the main oil gallery of the engine 200 (e.g., only the third oil supply passage 206, fourth oil supply passage 208, and fifth oil supply passage 207 flow oil to the corresponding HLAs at the second cylinder bank 212). The main oil gallery does not directly couple to any of the deactivatable HLAs 248, deactivatable HLAs 249, or the non-deactivatable HLAs 250.

Although the first cylinder bank 210 is shown including only the set of deactivatable HLAs 244 and non-deactivatable HLAs 246, it should be appreciated that the first cylinder bank 210 may additionally include a second set of deactivatable HLAs and non-deactivatable HLAs. In particular, the set of deactivatable HLAs 244 and the non-deactivatable HLAs 246 may be configured to control operation of a first set of valves (e.g., intake valves) of the cylinders of the first cylinder bank 210, and the second set of HLAs (not shown) may be configured to control operation of a second set of valves (e.g., exhaust valves) of the cylinders of the first cylinder bank 210. Similarly, although a single set of deactivatable HLAs 248, deactivatable HLAs 249, and non-deactivatable HLAs 250 is shown at the second cylinder bank 212, the HLAs shown may be configured to control operation of a first set of valves (e.g., exhaust valves) of the second cylinder bank 212. As such, the second cylinder bank 212 may include a second set of deactivatable HLAs and non-deactivatable HLAs to control operation of a second set of valves (e.g., intake valves) of the second cylinder bank 212.

The engine 200 further includes a third primer filter 280 fluidly coupled to the third oil supply passage 206 and a fourth primer filter 282 fluidly coupled to the fifth oil supply passage 207. The third primer filter 280 and fourth primer filter 282 may each be similar to, or the same as, the first primer filter 268 and/or second primer filter 270 described above. In particular, the third primer filter 280 includes orifice 281 and the fourth primer filter 282 includes orifice 283, where the orifice 281 and orifice 283 may each have a same size, shape, etc. as the orifice 269 described above, with the orifice 281 extending through the entire length of the third primer filter 280 and with the orifice 283 extending through the entire length of the fourth primer filter 282. The third primer filter 280 is configured to receive oil from the engine block 214 via passage 285 and to provide oil to the third oil supply passage 206 responsive to a pressure differential between the engine block 214 and the third oil supply passage 206. The fourth primer filter 282 is configured to receive oil from the engine block 214 via passage 287 and to provide oil to the fifth oil supply passage 207 responsive to a pressure differential between the engine block 214 and the fifth oil supply passage 207. In this way, the third primer filter 280 and fourth primer filter 282 may maintain the flow rate of oil to the third oil supply passage 206 and the fifth oil supply passage 207, respectively, above a pre-determined flow rate. The pre-determined flow rate may be the same as (e.g., equal to) the pre-determined flow rate described above with respect to the first oil supply passage 202.

The third oil supply passage 206 may be fluidly coupled to the engine block 214 via valve 288, and the fifth oil supply passage 207 may be fluidly coupled to the engine block 214 via valve 289. The valve 288 and the valve 289 may each be a solenoid valve, as one example. The valve 288 and the valve 289 may each be similar to, or the same as, the valve 264 and/or valve 266 described above. For example, valve 288 and valve 289 each include a respective pressure relief port, and the pressure relief ports may be similar to, or the same as, the pressure relief port 273 described above with reference to the valve 264. The pressure relief port of the valve 288 and the pressure relief port of the valve 289 may be configured to transition from a fully closed position to a fully opened position response to a pressure of oil within the third oil supply passage 206 and the fifth oil supply passage 207, respectively, being greater than a threshold pressure. In some examples, the threshold pressure may be the same as (e.g., equal to) the threshold pressure described above with reference to the pressure relief port of valve 264 and valve 266.

The controller of the engine may control an amount of opening of valve 288 in order to control a pressure of oil within the third oil supply passage 206, and the controller may control an amount of opening of a valve 289 in order to control a pressure of oil within the fifth oil supply passage 207. For example, the controller may adjust valve 288 to a fully opened position in order to increase the pressure of oil within third oil supply passage 206 (e.g., to adjust the deactivatable HLAs 248 to the deactivated mode), and/or the controller may adjust valve 289 to a fully opened position in order to increase the pressure of oil within the fifth oil supply passage 207 (e.g., to adjust the deactivatable HLAs 249 to the deactivated mode). Although the engine 200 includes both of the valve 288 and the valve 289 in the example shown, in other examples the engine may include only one of valve 288 or valve 289. For example, the engine may include only valve 288, with the valve 288 fluidly coupled to both of the third oil supply passage 206 and the fifth oil supply passage 207 and with the controller configured to control the amount of opening of valve 288 in order control the pressure of oil within each of the third oil supply passage 206 and the fifth oil supply passage 207.

Although the first primer filter 268 is described above, it should be appreciated that the second primer filter 270, third primer filter 280, and fourth primer filter 282 may each include a similar configuration (e.g., the second primer filter 270 may have a same shape as the first primer filter 268 and may be configured to flow oil to the first oil supply passage 202 responsive to a pressure differential between the engine block 214 an the first oil supply passage 202).

Similar to the example described above with reference to the first primer filter 268, the second primer filter 270, third primer filter 280, and fourth primer filter 282 may each reduce a likelihood of undesired degradation of the deactivatable HLAs and/or reduce a likelihood of delays to commanded adjustment of the deactivatable HLAs from the activated mode to the deactivated mode. In particular, the first primer filter 268 and second primer filter 270 may each be configured to flow oil from the engine block 214 to the first oil supply passage 202 responsive to a pressure differential between the engine block 214 and the first oil supply passage 202, the third primer filter 280 may be configured to flow oil from the engine block 214 to the third oil supply passage 206 responsive to a pressure differential between the engine block 214 and the third oil supply passage 206, and the fourth primer filter 282 may be configured to flow oil from the engine block 214 to the fifth oil supply passage 207 responsive to a pressure differential between the engine block 214 and the fifth oil supply passage 207. In this configuration, the flow rate of oil to the first oil supply passage 202, third oil supply passage 206, and fifth oil supply passage 207 may be more easily maintained above the pre-determined flow rate, and a likelihood of degradation and/or undesired delay of the deactivatable HLAs configured to receive oil from the first oil supply passage 202, third oil supply passage 206, and/or fifth oil supply passage 207 (e.g., via one or more deactivation oil inlets of the deactivatable HLAs, as described above) may be decreased.

Figure 3:
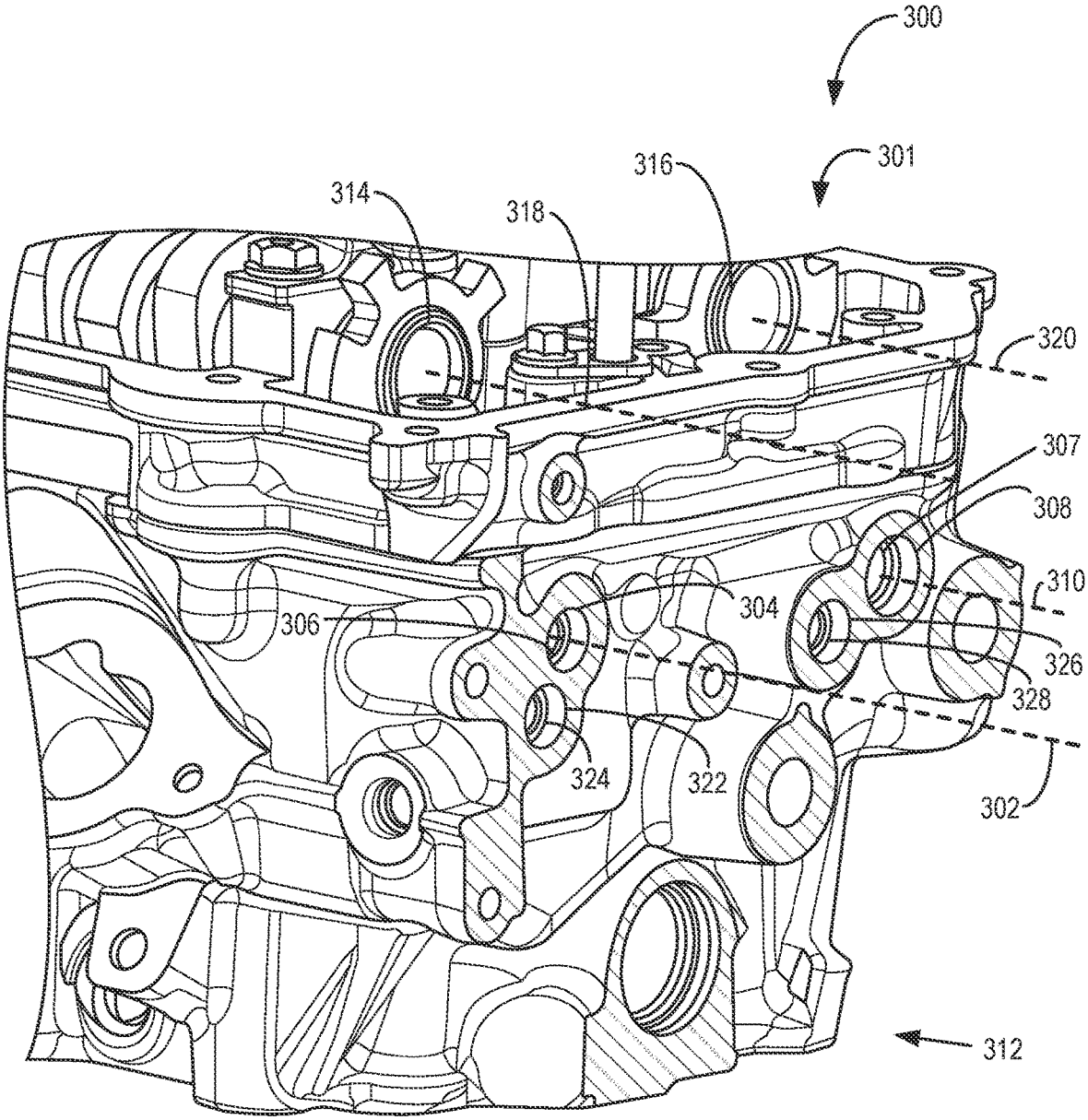
FIG. 3 shows an end perspective view of a cylinder head of an engine including oil passages fitted with primer filters and seats for hydraulic lash adjusters.

Referring to FIG. 3, a perspective view of a cylinder head 301 of an engine 300 is shown. In some examples, the engine 300 may be similar to, or the same as, the engine 200 shown by FIG. 2 and described above and/or the engine 10 shown by FIG. 1 and described above. The cylinder head 301 may be similar to, or the same as, the cylinder head 201 shown by FIG. 2 and/or the cylinder head 159 shown by FIG. 1 and described above. The engine 300 may include one or more cylinder banks, similar to the engine 200 described above with reference to FIG. 2, with the cylinder head 301 configured to cap the cylinders of the one or more cylinder banks. In the view of the cylinder head 301 shown by FIG. 3, a single cylinder bank of the engine 300 is shown. For example, the cylinder bank of the engine 300 shown by FIG. 3 may be similar to, or the same as, the second cylinder bank 212 shown by FIG. 2 and described above. However, in other examples, the engine 300 may have a different number of cylinder banks (e.g., the engine may include only a single cylinder bank having the configuration shown by FIG. 3).

The engine 300 includes a first camshaft 314 and a second camshaft 316 configured to drive (e.g., open and close) intake valves and/or exhaust valves of the cylinders of the engine. As one example, first camshaft 314 may be configured to drive a plurality of intake valves of the engine 300 (e.g., similar to intake valve 150 shown by FIG. 1 and described above), and the second camshaft 316 may be configured to drive a plurality of exhaust valves of the engine 300 (e.g., similar to exhaust valve 156 shown by FIG. 1 and described above). As another example, the first camshaft 314 may be configured to drive the plurality of exhaust valves, and the second camshaft 316 may be configured to drive the plurality of intake valves. The first camshaft 314 and second camshaft 316 may each extend between opposing ends of the engine 300 (e.g., from first end 312 to an opposing, second end, similar to first side 240 arranged opposite to second side 242 shown by FIG. 2 and described above). The first camshaft 314 extends parallel with axis 318, and second camshaft 316 extends parallel with axis 320, where the axis 318 is parallel with the axis 320.

The engine 300 further includes a plurality of openings arranged at the first end 312, where each of the openings is sealed by a corresponding plug. For example, FIG. 3 shows opening 304 sealed by plug 306, opening 322 sealed by plug 324, opening 308 sealed by plug 307, and opening 326 sealed by plug 328. Each opening may join directly to a respective passage within the cylinder head 301 and may be sealed from the respective passage by the respective plug. For example, plug 306 seals opening 304 from passage 400 (shown by FIG. 4 and described further below), plug 307 seals opening 308 from passage 500 (shown by FIG. 5 and described below), etc. Each of the plugs seals the respective openings such that fluid (e.g., oil, air, etc.) does not flow around the plugs and through the openings. For example, fluid disposed within the passage 400 joined to opening 304 does not flow from the passage 400 through the opening 304 due to the opening 304 being sealed by the plug 306. The plug 306 may be centered along axis 302, where axis 302 intersects each of a midpoint of the plug 306 and a midpoint of the opening 304. The plug 307 may be centered along axis 310, where axis 310 intersects each of a midpoint of the plug 307 and a midpoint of the opening 308. In the example shown by FIG. 3, the axis 302 is parallel with the axis 310. However, in other examples, the axis 302 and axis 310 may be angled relative to each other.

Figure 4:
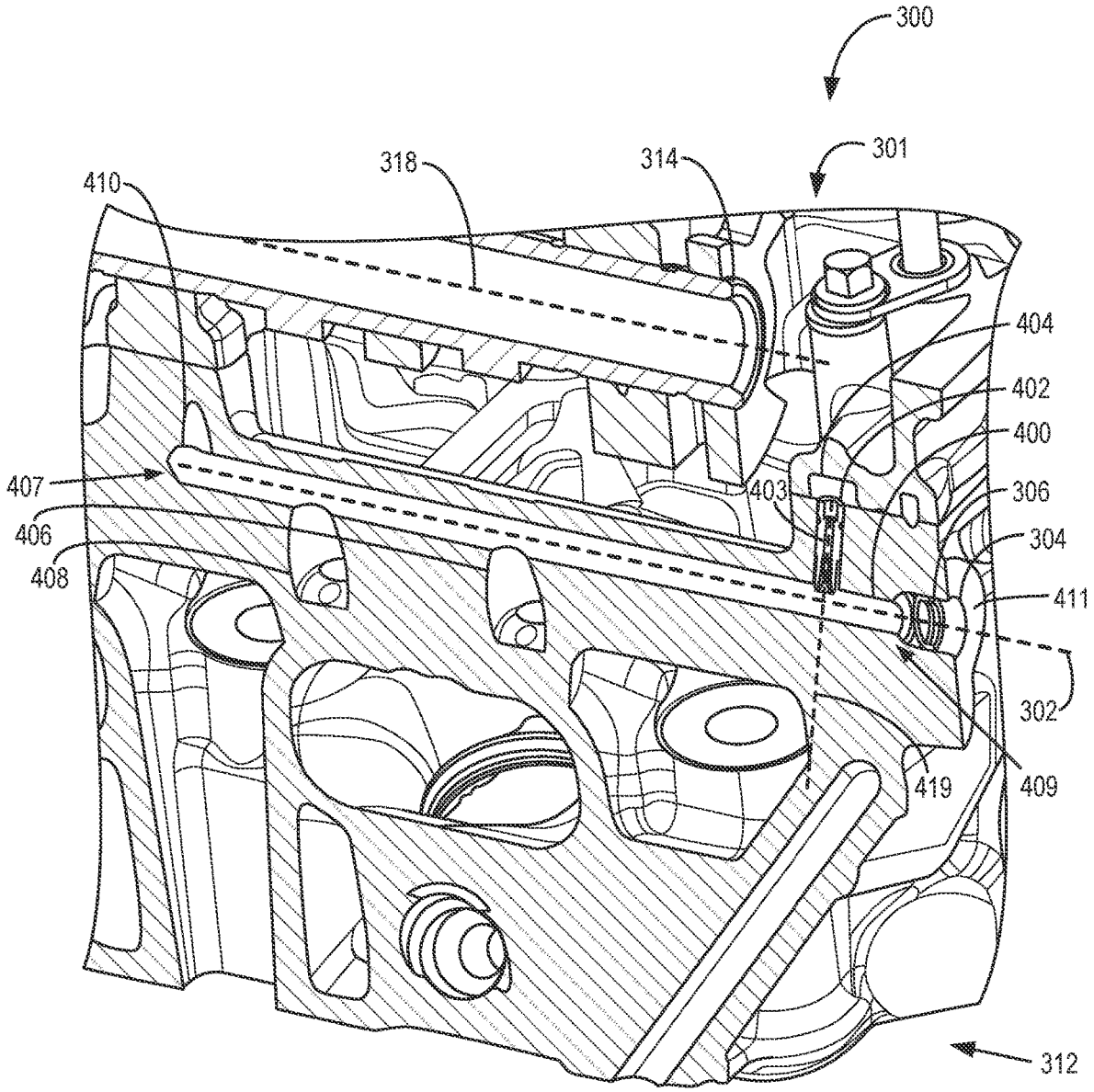
FIG. 4 shows a sectional view of a first primer filter seated within a first oil passage of the cylinder head of FIG. 3.
Figure 5:
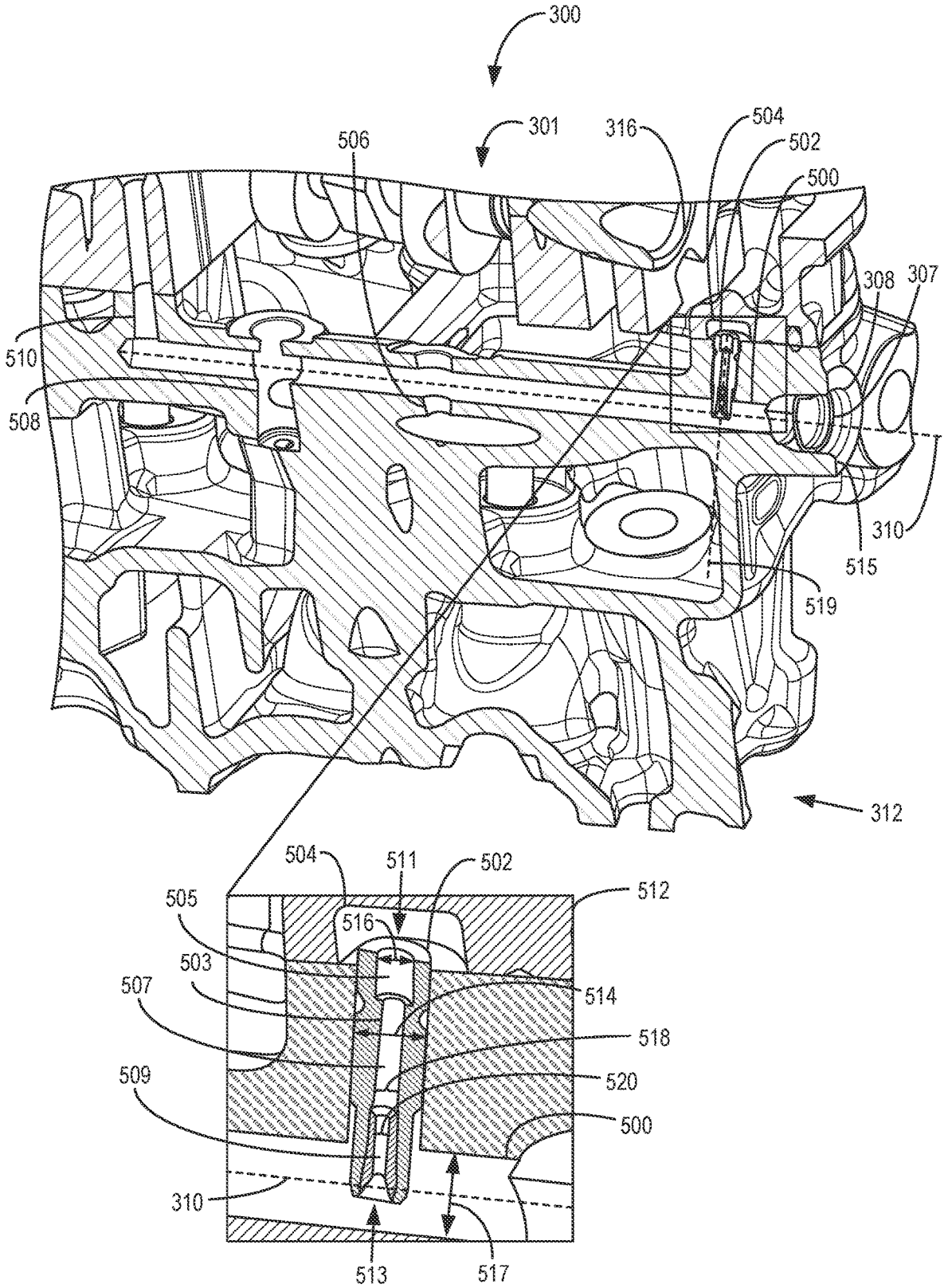
FIG. 5 shows a sectional view of a second primer filter seated within a second oil passage of the cylinder head of FIG. 3.

Referring collectively to FIGS. 4-5, sectional views of the cylinder head 301 of FIG. 3 are shown. In particular, FIG. 4 shows a sectional view of the cylinder head 301 approximately along axis 302, and FIG. 5 shows a sectional view of the cylinder head 301 approximately along axis 310. In the view shown by FIG. 4, axis 302 is shown extending parallel along a center of the passage 400. Plug 306 configured to seal the passage 400 is shown arranged at the first end 312. The passage 400 is an oil passage configured to provide oil (e.g., feed oil) to deactivatable HLAs of the engine 300 and may be referred to herein as an oil supply passage. For example, the passage 400 may be similar to, or the same as, the fifth oil supply passage 207 shown by FIG. 2 and described above. The passage 400 forms a plurality of seats configured to house the deactivatable HLAs. In particular, the passage 400 includes a first seat 406 configured to house a first deactivatable HLA and a second seat 408 configured to house a second deactivatable HLA, where the first deactivatable HLA and second deactivatable HLA may be similar to, or the same as, the deactivatable HLAs 249 shown by FIG. 2 and described above.

Each of the passage 400 shown by FIG. 4 and the passage 500 shown by FIG. 5 includes a respective primer filter. The primer filters may be similar to, or the same as, the primer filter 280 and/or primer filter 282 described above with reference to FIG. 2. In particular, the passage 400 includes primer filter 402, and the passage 500 includes primer filter 502. The passage 400 and the passage 500 may each be referred to herein as oil supply passages. The passage 400 and passage 500 each extend into the cylinder head 301 from the first end 312, with the passage 400 terminating at opening 304 formed in end surface 411 at the first end 312 of the cylinder head 301 and with the passage 500 terminating at opening 308 formed in end surface 515 at the first end 312 of the cylinder head 301. Primer filter 402 is configured to flow oil from the engine block of the engine 300 (e.g., similar to, or the same as, the engine block 214 described above with reference to FIG. 2) to the passage 400 automatically (e.g., without actuation, energization, adjustment, etc. of the primer filter 402 or other components) responsive to a pressure differential between the engine block and the passage 400 (e.g., during conditions in which a pressure of oil within the passage 400 is less than a pressure of oil within the engine block provided to the primer filter 402 upstream of the passage 400). The oil may flow automatically through the primer filter 402 to the passage 400 via an orifice 403 of the primer filter 402 extending through an entire length of the primer filter 402, similar to the examples described above with reference to FIG. 2. The orifice 403 may be similar to, or the same as, the primer filter orifices described above with reference to FIG. 2 (e.g., orifice 269, orifice 271, etc.). The primer filter 402 may be seated within the cylinder head 301 such that the orifice 403 extends in a vertical direction of the cylinder head 301 (e.g., a direction of axis 419, where axis 419 extends in a normal direction relative to a flat ground surface on which a vehicle including the engine 300 sits).

Passage 400 is configured to receive oil from inlet passage 410 (which may be referred to herein as an oil inlet), where inlet passage 410 is fluidly coupled to the engine block of the engine 300. For example, inlet passage 410 may be fluidly coupled to the engine block by a valve (e.g., solenoid valve) which may be similar to, or the same as, the valve 289 shown by FIG. 2 and described above. The controller of the engine 300 (e.g., similar to, or the same as, the controller 12 described above with reference to FIG. 1) may adjust an amount of opening of the valve in order to adjust the pressure of oil within the passage 400 (e.g., adjust a flow of higher pressure oil from the engine block to the passage 400). For example, the controller may command the valve to adjust from a fully closed position to a fully opened position in order to flow higher pressure oil to the passage 400 from the engine block via the inlet passage 410. Flowing oil to the passage 400 from the engine block via the valve may increase a pressure of oil within the passage 400, and in particular, may increase the pressure of the oil supplied to deactivation oil inlets of respective deactivatable HLAs seated within the seat 406 and seat 408 (e.g., similar to, or the same as, the deactivatable HLAs 249 described above with reference to FIG. 2). The increased pressure of the oil within the passage 400 may adjust the deactivatable HLAs from the activated mode to the deactivated mode.

Additionally, oil may flow from the engine block to the passage 400 via the primer filter 402. The primer filter 402 may receive oil from the engine block at oil inlet 404, where oil inlet 404 is arranged opposite to inlet passage 410 in a direction of passage 400 (e.g., oil inlet 404 is arranged toward the first end 312 of the cylinder head 301 in the direction of axis 302 at a first end 409 of the passage 400, while inlet passage 410 is arranged away from the first end 312 of the cylinder head 301 at a second end 407 of the passage 400 in the direction of axis 302).

The primer filter 402 may extend into each of the passage 400 and the oil inlet 404. The orifice 403 of the primer filter 402 is configured such that oil flows from the engine block to the passage 400 responsive to a pressure differential between the engine block and the passage 400 (e.g., during conditions in which the pressure of oil within the passage 400 is lower than the pressure of oil within the engine block). Further, although the primer filter 402 is configured to provide oil from the engine block to the passage 400, the configuration of the orifice 403 (e.g., the shape, size, etc. of the orifice 403) maintains the flow rate of oil to the passage above a pre-determined flow rate (e.g., the pre-determined flow rate described above with reference to FIG. 2) without increasing the pressure of oil within the passage 400 above a deactivation pressure of the deactivatable HLAs. For example, the deactivation pressure of the deactivatable HLAs may be 0.3 bar, and although the primer filter 402 may flow oil to the passage 400 responsive to a pressure differential between the engine block and the passage 400, the oil flow from the primer filter 402 does not increase the pressure of oil within the passage 400 above 2 bar. The deactivation pressure of the deactivatable HLAs refers to a pressure of the oil provided to the deactivation inlets of the deactivatable HLAs which results in adjustment of the deactivatable HLAs from the activated mode to the deactivated mode.

Similar to the examples described above with reference to FIG. 2, the valve may include a pressure relief port configured to flow oil from the passage 400 to a sump and/or crankcase during conditions in which the pressure of oil within the passage 400 exceeds a threshold pressure (e.g., 0.3 bar). The pressure relief port may be configured such that a flow rate of oil through the pressure relief port is approximately the same as (e.g., equal to) a flow rate of oil through the primer filter 402. In some examples, a rate of change of the pressure of the oil within the passage 400 resulting from oil flow to the passage 400 through the primer filter 402 may be less than 5% of a rate of change of the pressure of the oil within the passage 400 resulting from adjustment of the valve from the fully closed position to the fully opened position. Further, the rate of change of the pressure of the oil within the passage 400 resulting from the flow of oil from the passage 400 to the sump and/or crankcase via the pressure relief port of the valve may be approximately equal and opposite to the rate of change of the pressure of oil within the passage 400 resulting from the flow of oil to the passage 400 via the primer filter 402. In this configuration, during conditions in which oil flows into the passage 400 via the primer filter 402 and flows out of the passage 400 via the pressure relief port, the resultant net change in pressure of oil within the passage 400 may be approximately zero.

As described above, the activated mode refers to the mode in which the deactivatable HLAs enable the opening and closing of one or more valves (e.g., intake valves or exhaust valves) of one or more deactivatable cylinders of the engine 300, and the deactivated mode refers to the mode in which the deactivatable HLAs disable the opening and closing of the one or more valves. By configuring the primer filter 402 as described above, oil may flow into the passage 400 during conditions in which the pressure of oil within the passage 400 is less than the pressure of oil within the engine block, with the size and/or shape of the orifice 403 restricting the flow of oil from the engine block to the passage 400 and with the pressure relief port of the valve opening such that the pressure of the oil within the passage 400 does not exceed the deactivation pressure during conditions in which the valve is not opened (e.g., conditions in which the valve is not actuated to adjust the amount of opening of the valve to flow oil to the passage 400 from the engine block).

The passage 500 shown by FIG. 5 includes a similar configuration. In particular, passage 500 includes primer filter 502 which may be similar to, or the same as, the primer filter 402 described above. The primer filter 502 may receive oil from the engine block via inlet 504 and may automatically flow the oil to the passage 500 responsive to a pressure differential between the passage 500 and the engine block, similar to the examples described above. The passage further includes seat 506 and seat 508 each configured to house a respective deactivatable HLA (e.g., deactivatable HLAs 248 described above with reference to FIG. 2). As one example, the deactivatable HLAs housed by seat 406 and seat 408 (shown by FIG. 4) may be configured to control operation of intake valves of one or more deactivatable cylinders of the engine 300 (e.g., deactivatable cylinder 230 shown by FIG. 2 and described above), and the deactivatable HLAs housed by seat 506 and seat 508 may be configured to control operation of exhaust valves of the one or more deactivatable cylinders of the engine 300. In other examples, the deactivatable HLAs housed by seat 406 and seat 408 may be configured to control operation of exhaust valves of the one or more deactivatable cylinders, and the deactivatable HLAs housed by seat 506 and 508 may be configured to control operation of intake valves of the one or more deactivatable cylinders.

Similar to the inlet passage 410 described above with reference to FIG. 4, the passage 500 is configured to receive oil from the engine block via inlet passage 510, where the inlet passage 510 is disposed opposite to the plug 307 in the direction of axis 310. Inlet passage 510 may be fluidly coupled to the engine block by a valve (e.g., solenoid valve) which may be similar to, or the same as, the valve 289 shown by FIG. 2 and described above. As one example, the inlet passage 410 and inlet passage 510 may each be configured to receive oil from the engine block via the same valve such that during conditions in which the controller adjusts the valve from the fully closed position to the fully opened position, oil flows from the engine block to the passage 400 via inlet passage 410 and oil additionally flows from the engine block to the passage 500 via inlet passage 510. Flowing oil to the passage 500 via the inlet passage 510 and valve may increase a pressure of oil within the passage 500, and in particular, may increase the pressure of the oil supplied to deactivation oil inlets of respective deactivatable HLAs seated within the seat 506 and seat 508. The increased pressure of the oil within the passage 500 may adjust the deactivatable HLAs from the activated mode to the deactivated mode. The valve may include a pressure relief port, similar to the valves described above, with the pressure relief port fluidly coupled to the sump and/or crankcase. For example, the valve may be a three-way valve, with an inlet of the valve configured to receive oil from the engine block, with a first outlet of the valve configured to flow oil to the passage 400 and passage 500, and with the pressure relief port of the valve configured to flow oil to the oil reservoir. The controller may adjust the amount of opening of the valve to each of the oil passage 400, oil passage 500, and engine block in order to flow oil from the engine block to the passage 400 and passage 500, and the pressure relief port may open automatically (e.g., without energization of the valve) responsive to the pressure of oil within the passage 400 and passage 500 being greater than a threshold pressure (e.g., 0.3 bar) to flow oil from the passage 400 and passage 500 to the sump and/or crankcase.

As described above, the primer filter 502 may flow oil to the passage 500 responsive to a pressure differential between the oil within the passage 500 and the oil within the engine block. Inset 512 shown by FIG. 5 shows an enlarged view of the primer filter 502. Primer filter 502 includes orifice 503 extending through an entire length of the primer filter 502 from first end 511 to second end 513 of the primer filter 502. The orifice 503 may be similar to, or the same as, the orifice 403 described above with reference to FIG. 4, orifice 283 described above with reference to FIG. 2, etc. The primer filter 502 may be seated within the cylinder head 301 such that the orifice 503 extends in the vertical direction of the cylinder head 301 (e.g., a direction of axis 519, where axis 519 is arranged parallel with axis 419 and extends in the normal direction relative to the flat ground surface on which the vehicle including the engine 300 sits). Each of the orifice 403 of primer filter 402 and the orifice 503 of primer filter 502 may be arranged parallel with each other and perpendicular to each of the passage 400 and passage 500. The orifice 503 includes a first section 505 arranged at first end 511 of the primer filter 502, a second section 507 joined to the first section 505, and a third section 509 joined to the second section 507 and arranged at second end 513 of the primer filter 502, opposite to the first end 511. In this configuration, the first end 511 and first section 505 of the primer filter 502 are each arranged at the inlet passage 504, and during conditions in which oil flows from the engine block to the primer filter 502 via the inlet passage 504, the oil flows through the first section 505, then through the second section 507, then to the third section 509, and then to the passage 500 (e.g., the third section 509 is arranged downstream relative to the second section 507, and the second section 507 is arranged downstream relative to the first section 505). In the example shown, the first end 511 of the primer filter 502 extends into the inlet passage 504 and the second end 513 of the primer filter extends into the passage 500.

The orifice 403 decreases in diameter from the first end 511 toward the second end 513. In particular, the first section 505 has a first diameter 516, the second section 507 has a second diameter 518, and the third section 509 has a third diameter 520, with the first diameter 516 being larger than the second diameter 518, and with the second diameter 518 being larger than the third diameter 520. Each of the first diameter 516, second diameter 518, and third diameter 520 are smaller than an outer diameter 514 of the primer filter 502. Further, each of the first diameter 516, second diameter 518, and third diameter 520 are smaller than a diameter 517 of the passage 500. In some examples, the passage 500 and passage 400 (shown by FIG. 4) may have the same diameter. The outer diameter 514 of the primer filter 502 may be approximately the same (e.g., the same amount of length) as the diameter 517 of the passage 500. In some examples, the first diameter may be 4 millimeters. In some examples, the second diameter may be 2 millimeters. In some examples, the third diameter may be 0.5 millimeters.

By configuring the third diameter 520 to be smaller than the second diameter 518 and configuring the second diameter to be smaller than the first diameter 516, a rate of change of pressure of oil within the passage 500 responsive to a flow of oil from the inlet 504 to the passage 500 may be much smaller than a rate of change of pressure of oil within the passage 500 responsive to a flow of oil from the inlet passage 510 to the passage 500. For example, during conditions in which the controller commands the valve fluidly coupling the inlet passage 510 to the engine block to the fully opened position, the pressure of oil within the passage 500 may be substantially increased (e.g., increased from 0.3 bar to 2 bar). As a result, the pressure of oil within the passage 500 may be increased above the deactivation pressure as described above, and the deactivatable HLAs may be adjusted to the deactivated mode. However, oil flowing to the passage 500 through the primer filter 502 may not increase the pressure of the oil within the passage 500 above the deactivation pressure due to the restriction of the oil flow through the primer filter 502 by the orifice 503 (e.g., due to the decreasing diameters of the orifice 503 in the direction from the first end 511 to the second end 513) and due to the automatic opening of the pressure relief port of the valve responsive to the pressure of the oil within the passage 500 being above the threshold pressure. As a result, the primer filter 502 may maintain the flow rate of oil through the passage 500 above the pre-determined flow rate, and in particular during conditions in which the deactivatable HLAs are in the activated mode, without increasing the pressure of oil within the passage 500 above the deactivation pressure.

Additionally, by configuring the orifice 503 as described above, the primer filter 502 may urge the flow of oil from the oil inlet 504 to the passage 500 while resisting a flow of oil in the opposite direction from the passage 500 to the oil inlet 504. In particular, because the third diameter 520 of the third section is much smaller than the first diameter 516 of the first section 505, oil may be more likely to flow in the direction from the oil inlet 504 to the passage 500 and less likely to flow in the direction from the passage 500 to the oil inlet 504. In some examples, the first diameter 516 may be more than 150% of the third diameter 520. In other examples, the first diameter 516 may be more than double the third diameter 520.

Figure 6:
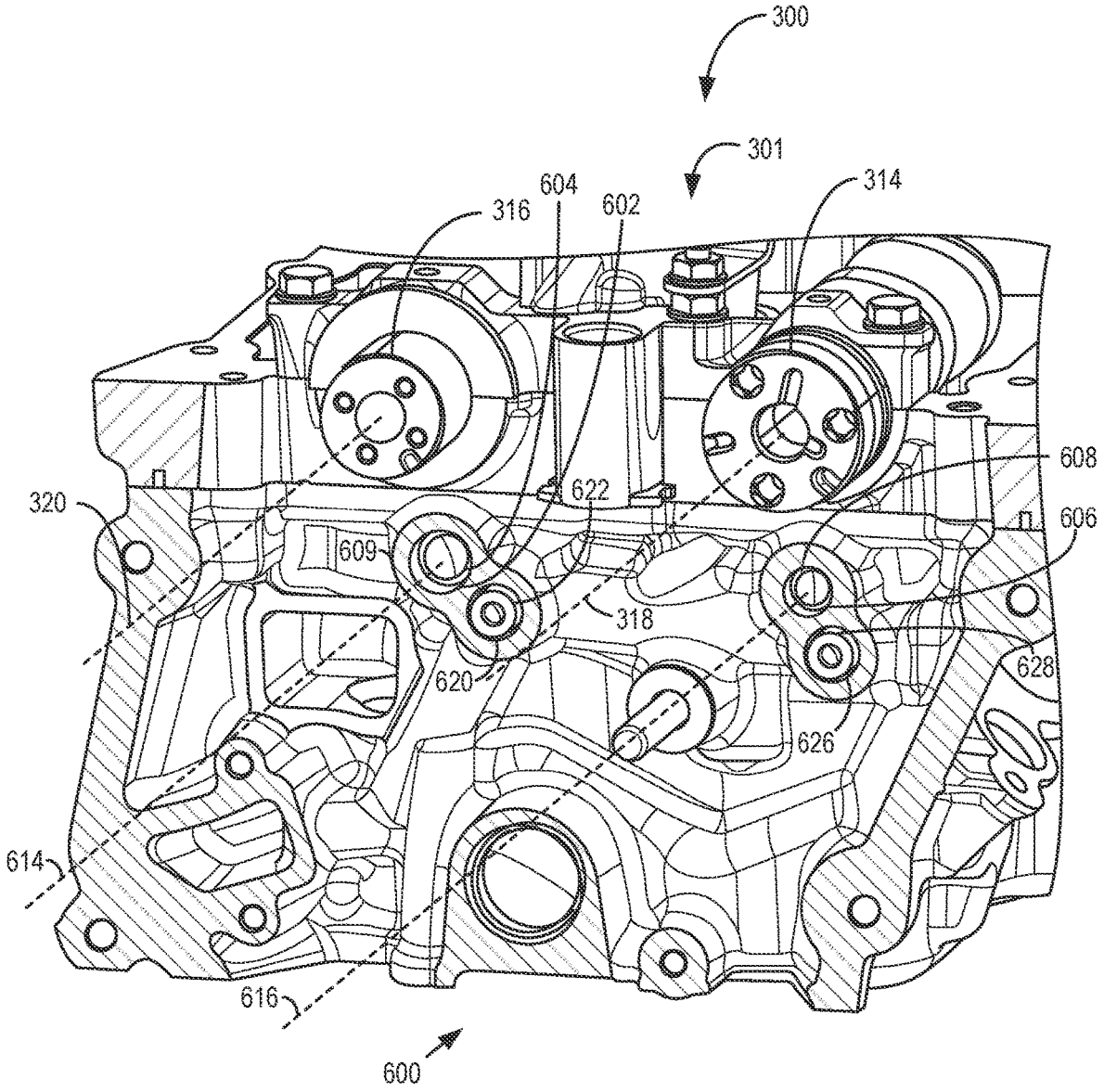
FIG. 6 shows another end view of the cylinder head of FIG. 3.
Figure 7:
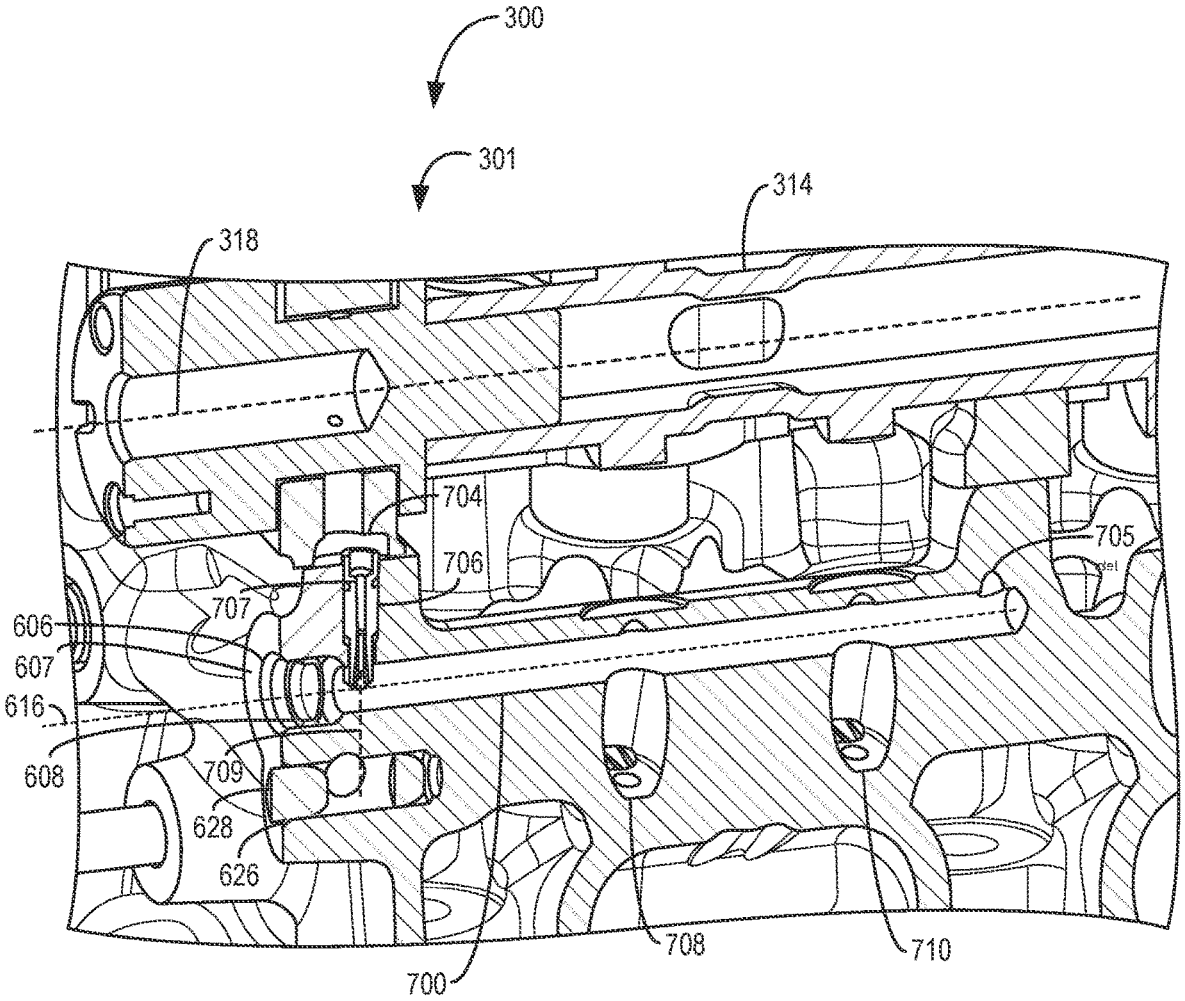
FIG. 7 shows a sectional view of a third primer filter seated within a third oil passage of the cylinder head of FIG. 3.
Figure 8:
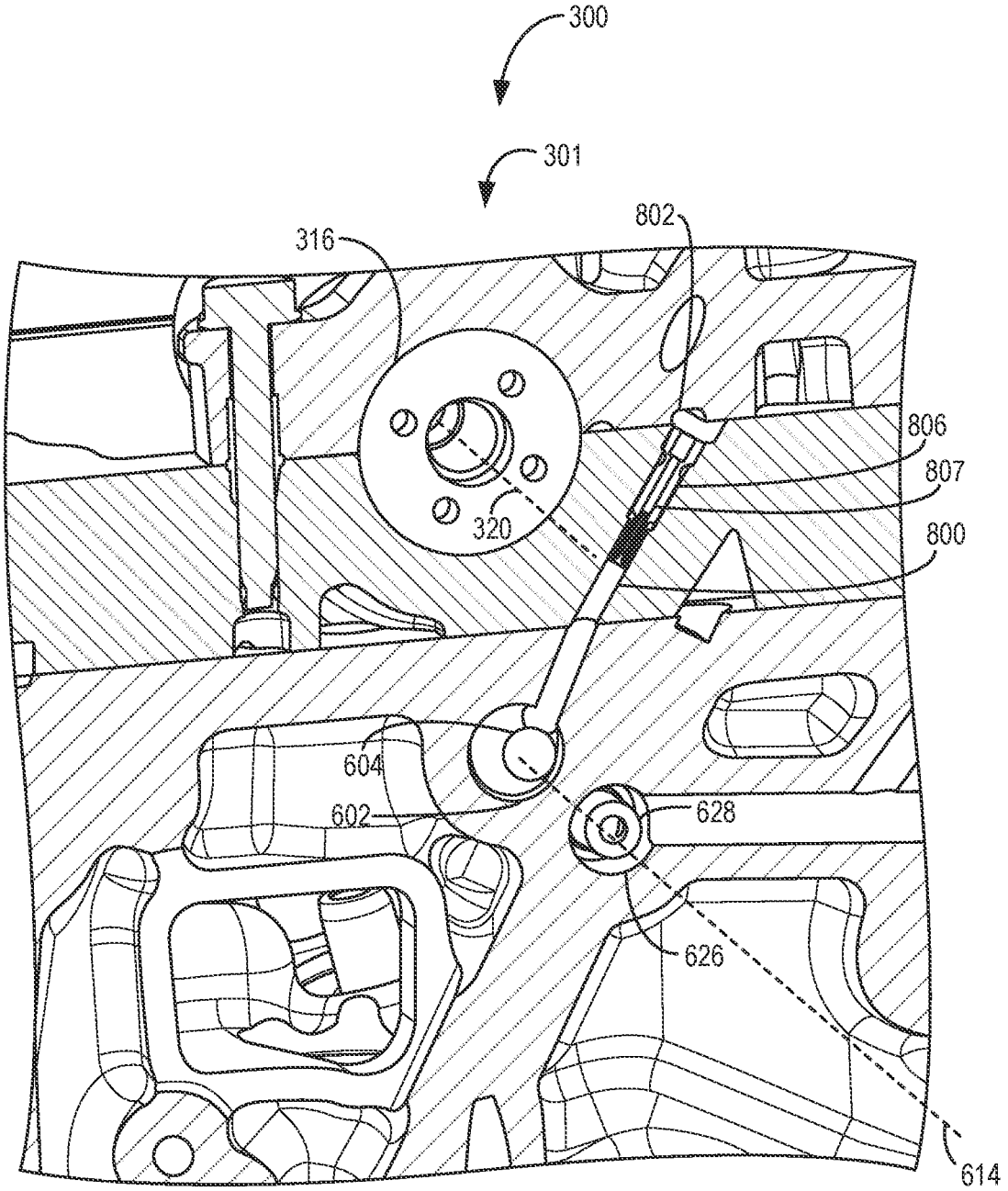
FIG. 8 shows a sectional view of a fourth primer filter seated within a fourth oil passage of the cylinder head of FIG. 3.

Referring collectively to FIGS. 6-8, various views of a second end 600 of the cylinder head 301 are shown. In particular, FIG. 6 shows a perspective view of the cylinder head 301 at the second end 600, FIG. 7 shows a sectional view of the cylinder head 301 approximately along axis 616, and FIG. 8 shows a sectional view of the cylinder head 301 approximately along axis 614.

Similar to the examples described above with reference to FIGS. 3-5, the second end 600 of the cylinder head 301 includes a plurality of openings sealed by respective plugs. In particular, as shown by FIG. 6, the second end 600 of the cylinder head 301 includes opening 602 sealed by plug 604, opening 620 sealed by plug 622, opening 606 sealed by plug 608, and opening 626 sealed by plug 628. Each opening may join to a respective passage within the cylinder head 301 and may be sealed from the respective passage by the respective plug. For example, plug 604 seals opening 602 from passage 800 (where the passage 800 is joined directly to opening 602 and is shown by FIG. 8 and described further below), plug 608 seals opening 606 from passage 700 (where the passage 700 is joined directly to opening 606 and is shown by FIG. 7 and described below), etc. Each of the plugs seals the respective openings such that fluid (e.g., oil, air, etc.) does not flow around the plugs and through the openings, similar to the examples described above.

As shown by FIG. 7, the passage 700 forms a seat 708 and a seat 710, where the seat 708 and seat 710 are each shaped to house a respective deactivatable HLA of the engine 300. The passage 700 further includes primer filter 706 configured to provide oil from the engine block (via oil inlet 704) to the passage 700 via orifice 707 responsive to a pressure differential between the engine block and the passage 700 (e.g., during conditions in which a pressure of oil within the passage 700 is less than a pressure of oil within the oil inlet 704, where the oil inlet 704 is provided oil by the engine block). The primer filter 706 provides the oil from the engine block (e.g., from oil inlet 704) to the passage 700 automatically (e.g., without actuation, energization, adjustment, etc. of the primer filter 706 or other components) responsive to the pressure of oil within the passage 700 being less than the pressure of oil within the engine block. The primer filter 706 may extend into each of the passage 700 and the oil inlet 704 in the vertical direction of the cylinder head 301 (e.g., a direction of axis 709, where axis 709 is arranged parallel with axis 419 shown by FIG. 4 and axis 519 shown by FIG. 5 and extends in the normal direction relative to the flat ground surface on which the vehicle including the engine 300 sits). The flow rate of oil to the passage 700 via the primer filter 706 may be similar to, or the same as, the flow rate of oil to the passage 400 via primer filter 402 shown by FIG. 4, passage 500 via primer filter 502 shown by FIG. 5, etc. The primer filter 706 may be similar to, or the same as, the primer filters described above (e.g., primer filter 402, primer filter 502, primer filter 280, etc.). Passage 700 may additionally selectably receive oil via inlet passage 705, where inlet passage 705 may be fluidly coupled to a valve (e.g., solenoid valve) controlled by the controller of the engine 300 (e.g., similar to the valve described above configured to provide oil to passage 400, the valve configured to provide oil to passage 500, valve 288 shown by FIG. 2 and described above, etc.).

Similarly, the passage 800 shown by FIG. 8 may form corresponding seats each shaped to receive a deactivatable HLA within the cylinder head 301. The passage 700 and passage 800 each extend into the cylinder head 301 from the second end 600, with the passage 700 terminating at opening 606 formed in end surface 607 at the second end 600 of the cylinder head 301 and with the passage 800 terminating at opening 602 formed in end surface 609 at the second end 600 of the cylinder head 301. The passage 800 includes primer filter 806 configured to provide oil from the engine block (via oil inlet 802) to the passage 800 during conditions in which the pressure of oil within the passage 800 is less than the pressure of oil within the engine block. The primer filter 806 provides the oil from the engine block to the passage 800 automatically (e.g., without actuation, energization, adjustment, etc. of the primer filter 806 or other components) responsive to the pressure of oil within the passage 800 being less than the pressure of oil within the engine block. The primer filter 806 may extend into each of the passage 800 and the oil inlet 802. The flow rate of oil through the primer filter 806 may be similar to, or the same as, the flow rate of oil through primer filter 402 shown by FIG. 4, the flow rate of oil through primer filter 502 shown by FIG. 5, the flow rate of oil through primer filter 706 shown by FIG. 7, etc. The primer filter 806 may be similar to, or the same as, the primer filters described above (e.g., primer filter 402, primer filter 502, primer filter 280, primer filter 706, etc.).

Passage 800 may additionally receive oil via an inlet passage opposite to the inlet 802 in a direction of axis 614, where the inlet passage may be fluidly coupled to a valve (e.g., solenoid valve) controlled by the controller of the engine 300 (e.g., similar to the valve described above configured to provide oil to passage 400, the valve configured to provide oil to passage 500, valve 288 shown by FIG. 2 and described above, etc.). In some examples, the valve fluidly coupled to the inlet passage configured to provide oil to the passage 800 may be the same valve fluidly coupled to the inlet passage 705 described above, such that the controller may open the valve (e.g., adjust the valve from the fully closed position to the fully opened position) in order to flow oil to each of the passage 700 and passage 800.

The deactivatable HLAs housed by the seats of the passage 700 and the passage 800 (e.g., seat 708, seat 710, etc.) may be configured to control operation of a first deactivatable cylinder of the engine 300 (e.g., similar to, or the same as, cylinder 228 shown by FIG. 2 and described above), and the deactivatable HLAs housed by the seats of the passage 400 (shown by FIG. 4) and passage 500 (shown by FIG. 5) may be configured to control operation of a second, different deactivatable cylinder of the engine 300 (e.g., similar to, or the same as, cylinder 230 shown by FIG. 2 and described above). The first end 312 of the cylinder head 301 may be similar to, or the same as, the second side 242 shown by FIG. 2 and described above, and the second end 600 of the cylinder head 301 may be similar to, or the same as, the first side 240 shown by FIG. 2 and described above. In some examples, the axis 614 shown by FIGS. 6 and 8 and the axis 616 shown by FIGS. 6-7 may each be parallel with the axis 302 and/or axis 310 shown by FIG. 3 and described above.

FIGS. 2-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In one embodiment, a system comprises: an engine including a plurality of deactivatable cylinders capped by a cylinder head; an oil supply passage formed in the cylinder head and joined to a first oil inlet; a plurality of deactivatable hydraulic lash adjusters (HLAs) arranged along a flow path of the oil supply passage and configured to receive engine oil directly from the oil supply passage to control deactivation of the plurality of deactivatable cylinders; and a primer filter disposed within the cylinder head and fluidly coupling the oil supply passage to a second oil inlet. In a first example of the system, the primer filter includes an orifice extending through an entire length of the primer filter from a first end to an opposing, second end. A second example of the system optionally includes the first example, and further includes wherein the orifice includes a first section arranged at the first end, a second section arranged at the second end, and a third section joining the first section to the second section. A third example of the system optionally includes one or both of the first and second examples, and further includes wherein a diameter of the first section is different than a diameter of the second section. A fourth example of the system optionally includes one or more or each of the first through third examples, and further includes wherein the diameter of the second section is less than a diameter of the third section, and a diameter of the third section is less than the diameter of the first section. A fifth example of the system optionally includes one or more or each of the first through fourth examples, and further includes wherein the diameter of the first section is less than a diameter of the oil supply passage. A sixth example of the system optionally includes one or more or each of the first through fifth examples, and further includes wherein the first oil inlet is arranged at a first end of the oil supply passage and the second oil inlet is arranged at an opposing, second end of the oil supply passage. A seventh example of the system optionally includes one or more or each of the first through sixth examples, and further includes wherein the second end of the oil supply passage joins directly to an opening formed in an end surface of the cylinder head, with the oil supply passage sealed by a plug disposed within the opening. An eighth example of the system optionally includes one or more or each of the first through seventh examples, and further includes wherein the first end of the primer filter extends into the second oil inlet and the second end of the primer filter extends into the oil supply passage. A ninth example of the system optionally includes one or more or each of the first through eighth examples, and further includes wherein the orifice of the primer filter extends in a vertical direction of the cylinder head.

In another embodiment, a system comprises: an engine including a plurality of cylinders capped by a cylinder head; an oil supply passage and first oil inlet joined together within the cylinder head; a plurality of deactivatable hydraulic lash adjusters seated within the cylinder head and fed directly by the oil supply passage; and a primer filter disposed within the cylinder head and configured to provide oil from a second oil inlet to the oil supply passage. In a first example of the system, the first oil inlet and second oil inlet each receive oil from an engine block of the engine. A second example of the system optionally includes the first example, and further includes wherein the primer filter includes an orifice shaped to automatically flow oil from the second oil inlet to the oil supply passage. A third example of the system optionally includes one or both of the first and second examples, and further includes wherein the first oil inlet is configured to provide oil to the oil supply passage at a first rate and the orifice of the primer filter is shaped to provide oil from the second oil inlet to the oil supply passage at a second rate, where the second rate is less than the first rate. A fourth example of the system optionally includes one or more or each of the first through third examples, and further includes wherein the second rate is less than 5% of the first rate. A fifth example of the system optionally includes one or more or each of the first through fourth examples, and further includes wherein the orifice is shaped to urge a flow of oil in a first direction from the second oil inlet to the oil supply passage and to resist a flow of oil in an opposite, second direction.

In another embodiment, a system comprises: an engine; a plurality of deactivatable cylinders capped by a cylinder head at a first end and an opposing, second end of the cylinder head; a first oil supply passage joined to a first oil inlet and extending within the cylinder head from the first end to a first plurality of deactivatable hydraulic lash adjusters; a second oil supply passage joined to a second oil inlet and extending within the cylinder head from the second end to a second plurality of deactivatable hydraulic lash adjusters; a first primer filter disposed within the cylinder head and fluidly coupling the first oil supply passage to a third oil inlet; and a second primer filter disposed within the cylinder head and fluidly coupling the second oil supply passage to a fourth oil inlet. In a first example of the system, the first primer filter and the second primer filter are each arranged parallel with each other and perpendicular to each of the first oil supply passage and the second oil supply passage. A second example of the system optionally includes the first example, and further includes wherein the first primer filter includes a first orifice having a first diameter at the third oil inlet and a second diameter at the first oil supply passage, and the second primer filter includes a second orifice having the first diameter at the fourth oil inlet and the second diameter at the second oil supply passage. A third example of the system optionally includes one or both of the first and second examples, and further includes wherein the first diameter is at least twice the second diameter.

In another representation, a vehicle comprises an engine including a plurality of deactivatable cylinders capped by a cylinder head, an oil supply passage formed in the cylinder head and joined to a first oil inlet, a plurality of deactivatable hydraulic lash adjusters (HLAs) arranged along a flow path of the oil supply passage and configured to receive engine oil directly from the oil supply passage to control deactivation of the plurality of deactivatable cylinders, a primer filter disposed within the cylinder head and fluidly coupling the oil supply passage to a second oil inlet, and an electric machine configured to selectably power a plurality of vehicle wheels.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an engine including a plurality of deactivatable cylinders capped by a cylinder head;

an oil supply passage formed in the cylinder head and joined to a first oil inlet;

a plurality of deactivatable hydraulic lash adjusters (HLAs) arranged along a flow path of the oil supply passage and configured to receive engine oil directly from the oil supply passage to control deactivation of the plurality of deactivatable cylinders; and a primer filter disposed within the cylinder head and fluidly coupling the oil supply passage to a second oil inlet;

wherein the first oil inlet is arranged at a first end of the oil supply passage and the second oil inlet is arranged at an opposing, second end of the oil supply passage; and wherein the second end of the oil supply passage joins directly to an opening formed in an end surface of the cylinder head, with the oil supply passage sealed by a plug disposed within the opening.

2. The system of claim 1, wherein the primer filter includes an orifice extending through an entire length of the primer filter from a first end to an opposing, second end.

3. The system of claim 2, wherein the orifice includes a first section arranged at the first end, a second section arranged at the second end, and a third section joining the first section to the second section.

4. The system of claim 3, wherein a diameter of the first section is different than a diameter of the second section.

5. The system of claim 4, wherein the diameter of the second section is less than a diameter of the third section, and a diameter of the third section is less than the diameter of the first section.

6. The system of claim 4, wherein the diameter of the first section is less than a diameter of the oil supply passage.

7. The system of claim 2, wherein the first end of the primer filter extends into the second oil inlet and the second end of the primer filter extends into the oil supply passage.

8. The system of claim 2, wherein the orifice of the primer filter extends in a vertical direction of the cylinder head.

9. A system, comprising:

an engine including a plurality of cylinders capped by a cylinder head having a camshaft;

an oil supply passage and first oil inlet joined together within the cylinder head;

a plurality of deactivatable hydraulic lash adjusters seated within the cylinder head and fed directly by the oil supply passage; and a primer filter disposed within the cylinder head and configured to provide oil from a second oil inlet to the oil supply passage;

wherein the first oil inlet is arranged at a first end of the oil supply passage and the second oil inlet is arranged at an opposing, second end of the oil supply passage; and wherein the oil supply passage is positioned parallel with the camshaft.

10. The system of claim 9, wherein the first oil inlet and second oil inlet each receive oil from an engine block of the engine.

11. The system of claim 9, wherein the primer filter includes an orifice shaped to automatically flow oil from the second oil inlet to the oil supply passage.

12. The system of claim 11, wherein the first oil inlet is configured to provide oil to the oil supply passage at a first rate and the orifice of the primer filter is shaped to provide oil from the second oil inlet to the oil supply passage at a second rate, where the second rate is less than the first rate.

13. The system of claim 12, wherein the second rate is less than 5% of the first rate.

14. The system of claim 11, wherein the orifice is shaped to urge a flow of oil in a first direction from the second oil inlet to the oil supply passage and to resist a flow of oil in an opposite, second direction.

15. A system, comprising:

an engine;

a plurality of deactivatable cylinders capped by a cylinder head at a first end and an opposing, second end of the cylinder head;

a first oil supply passage joined to a first oil inlet and extending within the cylinder head from the first end to a first plurality of deactivatable hydraulic lash adjusters;

a second oil supply passage joined to a second oil inlet and extending within the cylinder head from the second end to a second plurality of deactivatable hydraulic lash adjusters;

a first primer filter disposed within the cylinder head and fluidly coupling the first oil supply passage to a third oil inlet; and a second primer filter disposed within the cylinder head and fluidly coupling the second oil supply passage to a fourth oil inlet;

wherein the first primer filter and the second primer filter are each arranged parallel with each other and perpendicular to each of the first oil supply passage and the second oil supply passage.

16. The system of claim 15, wherein the first primer filter includes a first orifice having a first diameter at the third oil inlet and a second diameter at the first oil supply passage, and the second primer filter includes a second orifice having the first diameter at the fourth oil inlet and the second diameter at the second oil supply passage.

17. The system of claim 16, wherein the first diameter is at least twice the second diameter.

* * * * *